US009757625B2

(12) United States Patent
Nakano

(10) Patent No.: US 9,757,625 B2
(45) Date of Patent: Sep. 12, 2017

(54) GOLF CLUB

(71) Applicant: DUNLOP SPORTS CO. LTD., Kobe-shi, Hyogo (JP)

(72) Inventor: Takashi Nakano, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/156,593

(22) Filed: May 17, 2016

(65) Prior Publication Data

US 2016/0354647 A1 Dec. 8, 2016

(30) Foreign Application Priority Data

Jun. 5, 2015 (JP) ..... 2015-115245

(51) Int. Cl.
*A63B 53/00* (2015.01)
*A63B 53/10* (2015.01)

(52) U.S. Cl.
CPC ..... *A63B 53/00* (2013.01); *A63B 53/10* (2013.01); *A63B 2209/023* (2013.01)

(58) Field of Classification Search
CPC ..... A63B 53/00
See application file for complete search history.

(56) References Cited

U.S. PATENT DOCUMENTS

2006/0116217 A1* 6/2006 Oyama ..... A63B 53/00 473/316
2012/0295734 A1 11/2012 Hasegawa et al.
2013/0095951 A1* 4/2013 Nakamura ..... A63B 53/10 473/324

* cited by examiner

*Primary Examiner* — Michael Dennis
(74) *Attorney, Agent, or Firm* — Birch, Stewart, Kolasch & Birch, LLP

(57) ABSTRACT

A golf club 2 includes a shaft 6 having a weight of 50 g or less. The shaft 6 has a ratio of a center of gravity of 0.54 or greater. Respective EI values measured at intervals of 100 mm from a point 130 mm distant from a tip end Tp are defined as E1 to E10. A first region, a second region, and a third region are defined by boundaries at respective points having distances of 230 mm and 830 mm from the tip end Tp. In a graph on which the EI values are plotted, gradients of approximate straight lines in the first region, the second region, and the third region are defined as M1, M2, and M3, respectively. M1 to M3, E9/E6, and E10/E6 are fall within respective specified scopes. M3 is greater than M2.

8 Claims, 17 Drawing Sheets

GOLF CLUB

The present application claims priority on Patent Application No. 2015-115245 filed in JAPAN on Jun. 5, 2015, the entire contents of which are hereby incorporated by reference.

BACKGROUND OF THE INVENTION

Field of the Invention

The present invention relates to a golf club.

Description of the Related Art

A golf club shaft in which a center of gravity of the shaft is considered has been proposed. Japanese Patent Application Laid-Open No. 2012-239574 (US2012/0295734) discloses a shaft in which a ratio of a center of gravity of the shaft is 0.52 or greater but 0.65 or less.

SUMMARY OF THE INVENTION

The above mentioned conventional technique is effective in improvement of head speed. Meanwhile, the demand by golf players has been more and more increased. The present inventors have found a structure capable of further improving head speed based on a new standpoint.

It is an object of the present invention to provide a golf club excellent in flight distance performance.

A preferable golf club includes a head, a shaft, and a grip. The shaft has a weight of equal to or less than 50 g. A ratio of a center of gravity of the shaft is equal to or greater than 0.54.

In the shaft, an EI value at the point of 130 mm distant from a tip end is defined as E1, an EI value at the point of 230 mm distant from the tip end is defined as E2, an EI value at the point of 330 mm distant from the tip end is defined as E3, an EI value at the point of 430 mm distant from the tip end is defined as E4, an EI value at the point of 530 mm distant from the tip end is defined as E5, an EI value at the point of 630 mm distant from the tip end is defined as E6, an EI value at the point of 730 mm distant from the tip end is defined as E7, an EI value at the point of 830 mm distant from the tip end is defined as E8, an EI value at the point of 930 mm distant from the tip end is defined as E9, and an EI value at the point of 1030 mm distant from the tip end is defined as E10.

A region having a distance of equal to or less than 230 mm from the tip end is defined as a first region, a region having a distance of greater than 230 mm but less than 830 mm from the tip end is defined as a second region, and a region having a distance of equal to or greater than 830 mm from the tip end is defined as a third region.

In a graph obtained by plotting the 10 EI values on an x-y coordinate plane in which the x axis represents a distance (mm) between the tip end and a measurement point and the y axis represents the EI value (kgf·m$^2$), a gradient of a straight line obtained by approximating points in the first region with a least-square method is defined as M1, a gradient of a straight line obtained by approximating points in the second region with the least-square method is defined as M2, and a gradient of a linear expression obtained by approximating points in the third region with the least-square method is defined as M3.

Preferably, the shaft satisfies the following (a) to (f).

$$-0.015 \leq M1 \leq 0 \quad \text{(a)}$$

$$0.0008 \leq M2 \leq 0.008 \quad \text{(b)}$$

$$0.005 \leq M3 \leq 0.03 \quad \text{(c)}$$

$$M2 < M3 \quad \text{(d)}$$

$$1.7 \leq E9/E6 \leq 3.0 \quad \text{(e)}$$

$$2.0 \leq E10/E6 \leq 4.0 \quad \text{(f)}$$

Preferably, the shaft has a plurality of fiber reinforced resin layers. Preferably, the fiber reinforced resin layers include a first hoop layer, a second hoop layer positioned outside the first hoop layer, and an interposition layer positioned between the first hoop layer and the second hoop layer.

Preferably, the first hoop layer is a full length layer. Preferably, the second hoop layer is a full length layer. Preferably, the interposition layer includes a full length layer.

Preferably, the fiber reinforced resin layers include a butt partial layer. Preferably, the butt partial layer is a low-elastic layer having a fiber elastic modulus of equal to or less than 10 t/mm$^2$.

Preferably, the low-elastic layer is a glass fiber reinforced layer.

DESCRIPTION OF THE PREFERRED EMBODIMENTS

The present invention will be described later in detail based on preferred embodiments with appropriate reference to the drawings.

The term "layer" and the term "sheet" are used in the present application. The "layer" is a term for after being wound. Meanwhile, the "sheet" is a term for before being wound. The "layer" is formed by winding the "sheet". That is, the wound "sheet" forms the "layer".

In the present application, an axial direction means an axial direction of a shaft. In the present application, a circumferential direction means a circumferential direction of the shaft.

Figure 1:
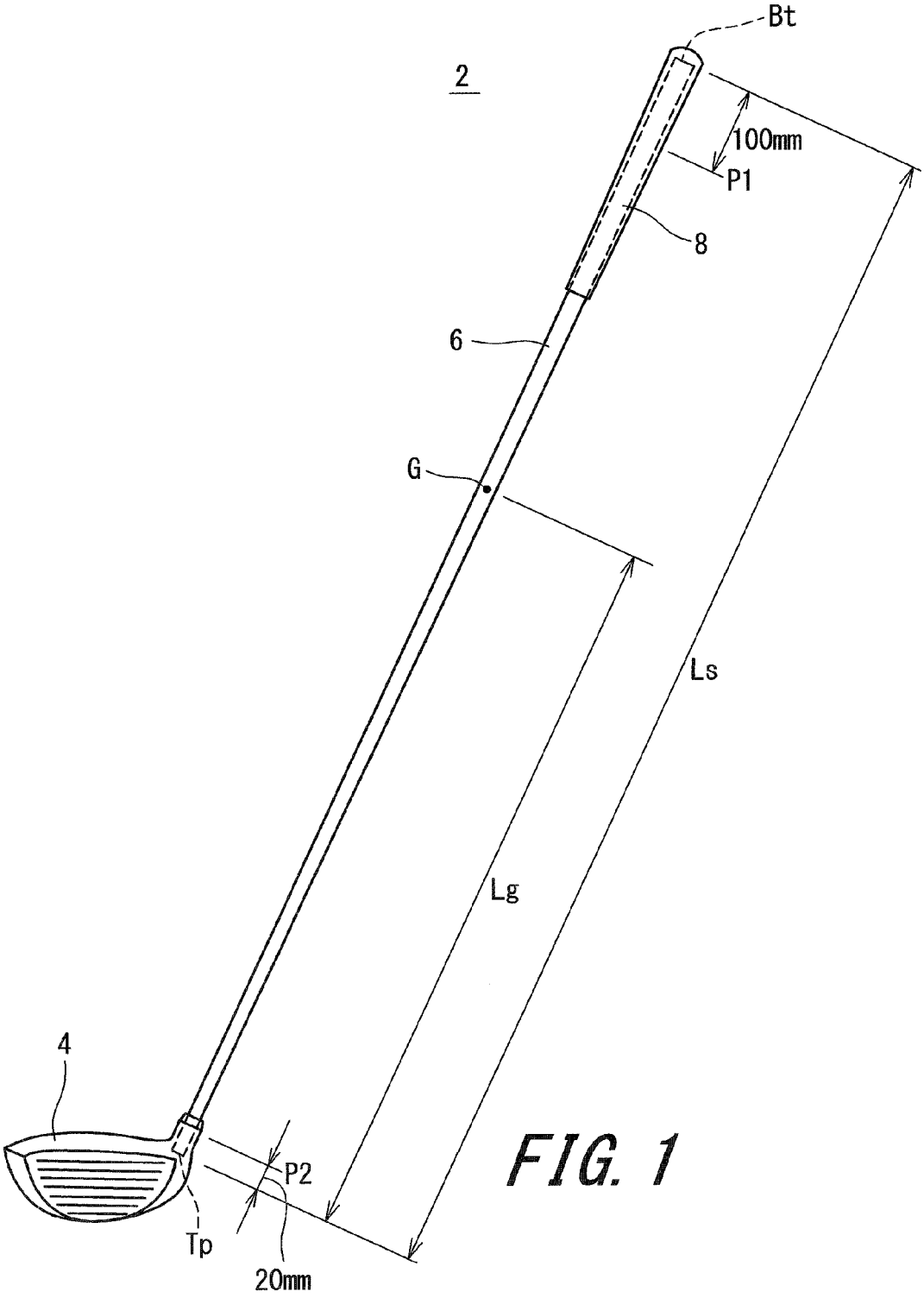
FIG. 1 shows a golf club including a shaft according to a first embodiment.

FIG. 1 shows a golf club 2 according to an embodiment of the present invention. The golf club 2 includes a head 4, a shaft 6, and a grip 8. The head 4 is provided at a tip portion of the shaft 6. The grip 8 is provided at a butt portion of the shaft 6. The shaft 6 is a shaft for wood type.

The head 4 and the grip 8 are not limited. Examples of the head 4 include a wood-type golf club head, an iron-type golf club head, a putter head, and the like.

The shaft 6 is formed by a plurality of fiber reinforced resin layers. The shaft 6 is a tubular body. Although not shown in the drawings, the shaft 6 has a hollow structure. As shown in FIG. 1, the shaft 6 has a tip end Tp and a butt end Bt. In the golf club 2, the tip end Tp is positioned in the head 4. In the golf club 2, the butt end Bt is positioned in the grip 8.

In FIG. 1, a double-pointed arrow Lg shows a distance between the tip end Tp and a center of gravity G of the shaft. The distance Lg is measured along the axial direction. In FIG. 1, a double-pointed arrow Ls shows a length of the shaft 6.

In the present application, Lg/Ls is also referred to as a ratio of a center of gravity of a shaft. By increasing the ratio of the center of gravity of a shaft, easiness of swing is secured even if the head weight is increased. Therefore, flight distance can be increased. In this respect, Lg/Ls is preferably equal to or greater than 0.54, more preferably equal to or greater than 0.55, and still more preferably equal to or greater than 0.56. In view of the strength of a tip part, Lg/Ls is preferably equal to or less than 0.61, and more preferably equal to or less than 0.60.

The shaft 6 is formed by winding a plurality of prepreg sheets. In these prepreg sheets, fibers are oriented substantially in one direction. The prepreg in which fibers are oriented substantially in one direction is also referred to as a UD prepreg. The term "UD" stands for uni-direction. Prepregs which are not the UD prepreg may be used. For example, fibers contained in the prepreg sheet may be woven.

The prepreg sheet has a fiber and a resin. The resin is also referred to as a matrix resin. Examples of the fiber include a carbon fiber and a glass fiber. Typically, the matrix resin is a thermosetting resin.

The shaft 6 is manufactured by a so-called sheet-winding method. In the prepreg, the matrix resin is in a semi-cured state. In the shaft 6, the prepreg sheet is wound and cured. The curing means the curing of the semi-cured matrix resin. The curing is attained by heating. The manufacturing process of the shaft 6 includes a heating process. The heating cures the matrix resin of the prepreg sheet.

Figure 2:
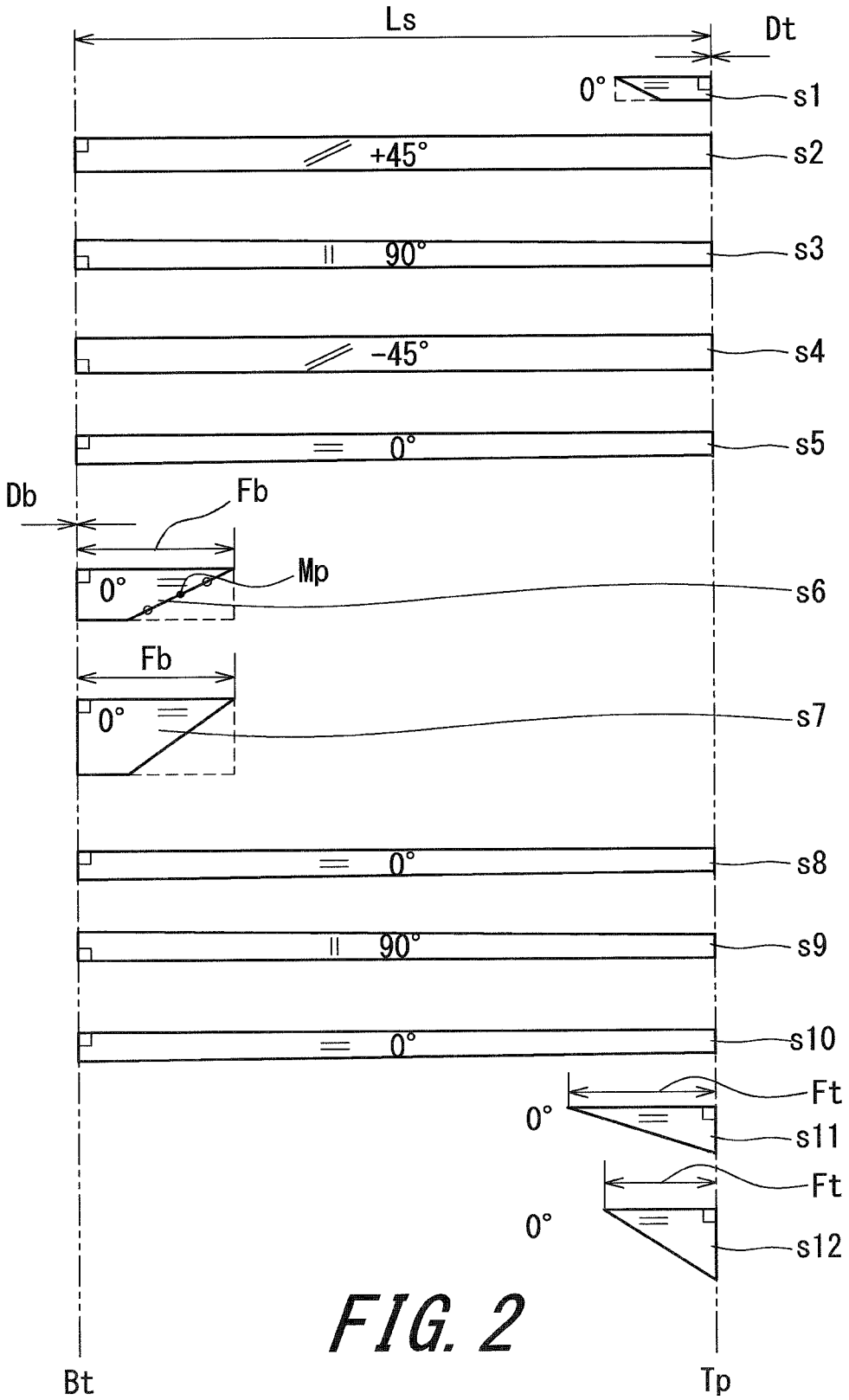
FIG. 2 is a developed view of the shaft according to the first embodiment.

FIG. 2 is a developed view of the prepreg sheets constituting the shaft 6. FIG. 2 shows the sheets constituting the shaft 6. The shaft 6 is constituted with a plurality of sheets. In the embodiment of FIG. 2, the shaft 6 is constituted with twelve sheets. The shaft 6 includes a first sheet s1 to a 12th sheet s12. The developed view shows the sheets constituting the shaft in order from the radial inside of the shaft. The sheets are wound in order from the sheet located on the uppermost side in FIG. 2. In FIG. 2, the horizontal direction of the figure coincides with the axial direction. In FIG. 2, the right side of the figure is the tip side of the shaft. In FIG. 2, the left side of the figure is the butt side of the shaft.

FIG. 2 shows not only the winding order of the sheets but also the disposal of each of the sheets in the axial direction of the shaft. For example, in FIG. 2, an end of the sheet s1 is located at the tip end Tp.

The shaft 6 includes a straight layer and a bias layer. In FIG. 2, the orientation angle of the fiber is described. A sheet described as "0°" is a straight sheet. The straight sheet constitutes the straight layer.

The straight layer is a layer in which the orientation of the fiber is substantially 0 degree to the axial direction. Usually, the orientation of the fiber is not to be completely parallel to the axis direction of the shaft due to an error or the like in winding. In the straight layer, an absolute angle θa of the fiber to the axis line of the shaft is equal to or less than 10 degrees. The absolute angle θa is an absolute value of an angle between the axis line of the shaft and the direction of the fiber. That is, the absolute angle θa of equal to or less than 10 degrees means that an angle Af between the direction of the fiber and the axis direction of the shaft is −10 degrees or greater but +10 degrees or less.

In the first embodiment of FIG. 2, the straight sheets are the sheet s1, the sheet s5, the sheet s6, the sheet s7, the sheet s8, the sheet s10, the sheet s11 and the sheet s12. The straight layer contributes to improvement of a flexural rigidity and a flexural strength.

The bias layer can enhance a torsional rigidity and a torsional strength of the shaft. Preferably, the bias layer includes a pair of sheets in which the orientations of the fibers are inclined in opposite directions to each other. Preferably, the pair of sheets include a layer having an angle Af of −60 degrees or greater but −30 degrees or less and a layer having an angle Af of 30 degrees or greater but 60 degrees or less. That is, preferably, the absolute angle θa in the bias layer is 30 degrees or greater but 60 degrees or less.

In the shaft 6, sheets constituting the bias layer are the sheet s2 and the sheet s4. In FIG. 2, the angle Af is described in each sheet. The plus (+) and minus (−) in the angle Af show that the fibers of bias sheets stacked to each other are inclined in opposite directions to each other. In the present application, the sheet for the bias layer is also simply referred to as a bias sheet.

A hoop layer is a layer so disposed that the fiber is oriented along the circumferential direction of the shaft. Preferably, the absolute angle θa in the hoop layer is substantially 90 degrees to the axis line of the shaft. However, the orientation of the fiber to the axis direction of the shaft may not be completely set to 90 degrees due to an error or the like in winding. Normally, in the hoop layer, the absolute angle θa is equal to or greater 80 degrees. The upper limit value of the absolute angle θa is 90 degrees. That is, the absolute angle θa of the hoop layer is equal to or less than 90 degrees.

The hoop layer contributes to increases in the crushing rigidity and the crushing strength of the shaft. The crushing rigidity is a rigidity against a crushing deformation. The crushing deformation is generated by a force crushing the shaft toward the inside in the radial direction thereof. In a typical crushing deformation, the cross section of the shaft is deformed from a circular shape to an elliptical shape. The crushing strength is a strength against the crushing deformation. The crushing strength can also be involved with the flexural strength. Crushing deformation can be generated linked with flexural deformation. In a particularly thin lightweight shaft, this linkage is large. The improvement in the crushing strength can contribute to improvement of the flexural strength.

In the embodiment of FIG. 2, prepreg sheets for the hoop layer are the sheet s3 and the sheet s9. The prepreg sheet for the hoop layer is also referred to as a hoop sheet. The shaft 6 includes the hoop layer s3 sandwiched between the bias layers s2 and s4.

The prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semi-cured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding another prepreg sheet around the mandrel. Next, the mold release paper is peeled. Next, the wound object is rotated to wind the prepreg sheet around the wound object. Thus, after the winding start edge part is applied on the wound object, the mold release paper is peeled. The procedure suppresses the wrinkles and winding fault of the sheet.

A united sheet is used in the embodiment of FIG. 2. The united sheet is formed by stacking a plurality of sheets.

Two united sheets are formed in the embodiment of FIG. 2. A first united sheet is a combination of the sheet s2, the sheet s3, and the sheet s4. A second united sheet is a combination of the sheet s9 and the sheet s10.

As described above, in the present application, the sheet and the layer are classified by the orientation angle of the fiber. In addition, in the present application, the sheet and the layer are classified by the length thereof in the axial direction.

A layer disposed wholly in the axial direction is referred to as a full length layer. A sheet disposed wholly in the axial direction is referred to as a full length sheet. The wound full length sheet forms the full length layer.

Meanwhile, a layer disposed partially in the axial direction is referred to as a partial layer. A sheet disposed partially in the axial direction is referred to as a partial sheet. The wound partial sheet forms the partial layer.

The full length layer that is the bias layer is referred to as a full length bias layer. In the present application, the full length layer that is the straight layer is referred to as a full length straight layer. In the present application, the full length layer that is the hoop layer is referred to as a full length hoop layer.

In the present application, the partial layer that is the straight layer is referred to as a partial straight layer.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the process to produce the united sheets. In the stacking process, heating or a press may be used.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

A winding body is obtained in the winding process. In the winding body, the winding process of winding the prepreg sheet around the outside of the mandrel is performed by, for example, rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the tape. A pressure is applied to the winding body by the wrapping tape. The pressure contributes to reduction of voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The fastening force of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel.

(7) Process of Cutting Both Ends

Both the end parts of the cured laminate are cut in the process. The cutting flattens the end face of the tip end Tp and the end face of the butt end Bt.

(8) Polishing Process

The surface of the cured laminate is polished in the process. As the trace of the wrapping tape, spiral unevenness is present on the surface of the cured laminate. The polishing extinguishes the unevenness to smooth the surface of the cured laminate.

(9) Coating Process

The cured laminate after the polishing process is subjected to coating.

In the present application, the same reference character is used in the layer and the sheet. For example, a layer formed by the sheet s1 is the layer s1.

In the shaft 6, the full length sheets are the sheet s2, the sheet s3, the sheet s4, the sheet s5, the sheet s8, the sheet s9 and the sheet s10. The sheet s2 and the sheet s4 are the full length bias sheets. The sheet s5, the sheet s8 and the sheet s10 are the full length straight sheets. The sheet s3 and the sheet s9 are the full length hoop sheets.

In the shaft 6, the partial sheets are the sheet s1, the sheet s6, the sheet s7, the sheet s11 and the sheet s12. The sheet s1, the sheet s11 and the sheet s12 are the tip partial sheets. The sheet s6 and the sheet s7 are butt partial sheets.

A double-pointed arrow Dt in FIG. 2 represents a distance between the tip partial sheet and the tip end Tp. The distance Dt is measured along the axial direction. In hitting, stress is apt to be concentrated on the vicinity of the end face of the hosel. In this respect, the distance Dt is preferably equal to or less than 20 mm. In other words, the tip partial sheet is preferably disposed to include a position P2 of 20 mm distant from the tip end Tp. The position P2 is shown in FIG. 1. The distance Dt is more preferably equal to or less than 10 mm. The distance Dt may be 0 mm. In the embodiment, the distance Dt is 0 mm.

A double-pointed arrow Ft in FIG. 2 represents a length (full length) of the tip partial sheet. The length Ft is measured along the axial direction. In hitting, stress is apt to be concentrated on the vicinity of the end face of the hosel. In this respect, the length Ft is preferably equal to or greater than 50 mm, more preferably equal to or greater than 100 mm, and still more preferably equal to or greater than 150 mm. In respect of the position of the center of gravity of the shaft, the length Ft is preferably equal to or less than 400 mm, more preferably equal to or less than 350 mm, and still more preferably equal to or less than 300 mm.

A double-pointed arrow Db in FIG. 2 represents a distance between the butt partial sheet and the butt end Bt. The distance Db is measured along the axial direction. In respect of the position of the center of gravity of the shaft, the distance Db is preferably equal to or less than 100 mm. In other words, the butt partial sheet is preferably disposed to include a position P1 of 100 mm distant from the butt end Bt. The position P1 is shown in FIG. 1. The distance Db is more preferably equal to or less than 70 mm, and still more preferably equal to or less than 50 mm. The distance Db may be 0 mm. In the embodiment, the distance Db is 0 mm.

A double-pointed arrow Fb in FIG. 2 represents a length (full length) of the butt partial sheet. The length Fb is measured along the axial direction. In respect of the position of the center of gravity of the shaft, the weight of the butt partial sheet is preferably great. In this respect, the length Fb is preferably equal to or greater than 250 mm, more preferably equal to or greater than 300 mm, and still more preferably equal to or greater than 350 mm. An excessively large length Fb reduces the effect of shifting the position of the center of gravity of the shaft. In this respect, the length Fb is preferably equal to or less than 650 mm, more preferably equal to or less than 600 mm, still more preferably equal to or less than 580 mm, and yet still more preferably equal to or less than 560 mm.

The embodiment of FIG. 2 includes a plurality of (two) butt partial sheets.

The first butt partial sheet s6 is the straight sheet. The distance Db of the first butt partial sheet s6 is 0 mm. The butt partial sheet s6 is disposed outside the full length bias sheets s2 and s4. At least one full length straight sheet is provided outside the butt partial sheet s6.

The second butt partial sheet s7 is the straight sheet. The distance Db of the second butt partial sheet s7 is 0 mm. The butt partial sheet s7 is disposed outside the full length bias sheets s2 and s4. At least one full length straight sheet is provided outside the butt partial sheet s7.

The sheet s1 is the straight tip partial sheet. The sheet s1 is disposed inside the full length bias sheets s2 and s4.

The sheet s11 is the straight tip partial sheet. The sheet s11 is disposed outside the outermost full length straight layer.

The sheet s12 is the straight tip partial sheet. The sheet s12 is disposed outside the outermost full length straight layer. The sheet s12 is disposed outside the sheet s11.

In the embodiment, a glass fiber reinforced prepreg is used. In the embodiment, the glass fiber is oriented substantially in one direction. That is, the glass fiber reinforced prepreg is a UD prepreg. A glass fiber reinforced prepreg other than the UD prepreg may be used. For example, glass fibers contained in the prepreg may be woven.

In the embodiment, the sheet s6 is a glass fiber reinforced sheet. The butt partial layer s6 is a glass fiber reinforced layer.

A prepreg other than the glass fiber reinforced prepreg is a carbon fiber reinforced prepreg. Sheets other than the sheet s6 are carbon fiber reinforced sheets. Examples of the carbon fiber include a PAN based carbon fiber and a pitch based carbon fiber.

The sheet s6 is a low-elastic layer. The low-elastic layer means a layer having a fiber elastic modulus of equal to or less than 10 tf/mm$^2$. The elastic modulus of the glass fiber is approximately 7 to 8 tf/mm$^2$.

The glass fiber has a large compressive breaking strain. The glass fiber is effective in improvement of an impact-absorbing energy. The impact strength of the butt portion is improved by adopting the glass fiber reinforced layer as the butt partial layer. The butt partial layer is provided at the position of the grip, and thus has a high correlation with feeling. Felling upon shots becomes favorable by adopting the glass fiber reinforced layer as the butt partial layer.

Examples of the fiber used for the low-elastic layer include a low-elastic carbon fiber in addition to the glass fiber. A preferable low-elastic carbon fiber is a pitch based carbon fiber.

The ratio of the center of gravity of the shaft can be increased by increasing the weight of the butt portion. However, if the weight of the butt portion is increased, the flexural rigidity of the butt portion is apt to be excessively large. In this case, the butt portion is hard to bend and to thereby reduce an inside-path effect (to be described later). By adopting the low-elastic layer as the butt partial layer, the flexural rigidity of the butt portion can be suppressed while the ratio of the center of gravity of the shaft is increased. In the shaft 6, the head speed is increased by the synergistic effect of the ratio of the center of gravity of the shaft and the inside-path effect (to be described later).

[Sandwich Structure]

The laminated constitution in FIG. 2 includes the first hoop layer s3 and the second hoop layer s9. The second hoop layer s9 is positioned outside the first hoop layer s3. An interposition layer is present between the first hoop layer s3 and the second hoop layer s9. The interposition layer is a layer other than the hoop layer. In the laminated constitution, interposition layers vary depending on their position in the axial direction of the shaft. In a region in which the butt partial layers s6 and s7 are present, the interposition layers are the layer s4, the layer s5, the layer s6, the layer s7 and the layer s8. In a region in which the butt partial layers s6 and s7 are not present, the interposition layers are the layer s4, the layer s5 and the layer s8. The structure in which an interposition layer is present between two hoop layers is also referred to as a sandwich structure.

The interposition layers include the bias layer s4. The bias layer s4 is the full length layer (full length bias sheet). The interposition layers include the butt partial layers s6 and s7. The interposition layers include the full length straight layers s5 and s8.

The first hoop layer s3 is disposed between the first bias layer s2 and the second bias layer s4. The full length layer present inside the first hoop layer s3 is only the first bias layer s2. The full length layer present outside the second hoop layer s9 is only the straight layers s10, s11 and s12.

In the deformation of a shaft, the flexural deformation causes the crushing deformation. In the crushing deformation, the curvature of the cross-section shape of the shaft varies depending on its circumferential position. That is, when the cross-section is deformed to have an elliptical shape by the crushing deformation, a portion having a small curvature and a portion having a large curvature are combined in the cross-section. The hoop layer is hard to follow the variation of the curvature since the fibers are oriented in the circumferential direction. Meanwhile, the straight layer and the bias layer are apt to follow the variation of the curvature since the fibers are not oriented in the circumferential direction.

Therefore, when the hoop layers are overlapped to each other, the layers are apt to be peeled from each other because of a difference between the radial positions of the hoop layers. On the other hand, when the straight layer or the bias layer is overlapped with the hoop layer, the peeling between layers is comparatively less likely to occur. From these viewpoints, it is preferable that two hoop layers are not overlapped to each other. It is preferable that a layer other than the hoop layer is interposed between the hoop layers. It is preferable that the straight layer and/or the bias layer are/is interposed between the hoop layers. That is, the sandwich structure is preferred. The sandwich structure enhances the flexural strength. In light of weight reduction, the thickness of the hoop layer per layer is preferably equal to or less than 0.05 mm. In light of enhancing the effect brought by the hoop layer, the thickness of the hoop layer per layer is preferably equal to or greater than 0.02 mm.

The first hoop layer s3 is the full length layer. The second hoop layer s9 is the full length layer. The interposition layers include the full length layers s4, s5 and s8. Therefore, the effect of the sandwich structure is exhibited over the full length of the shaft, and the strength of the whole shaft is enhanced.

Figure 3:
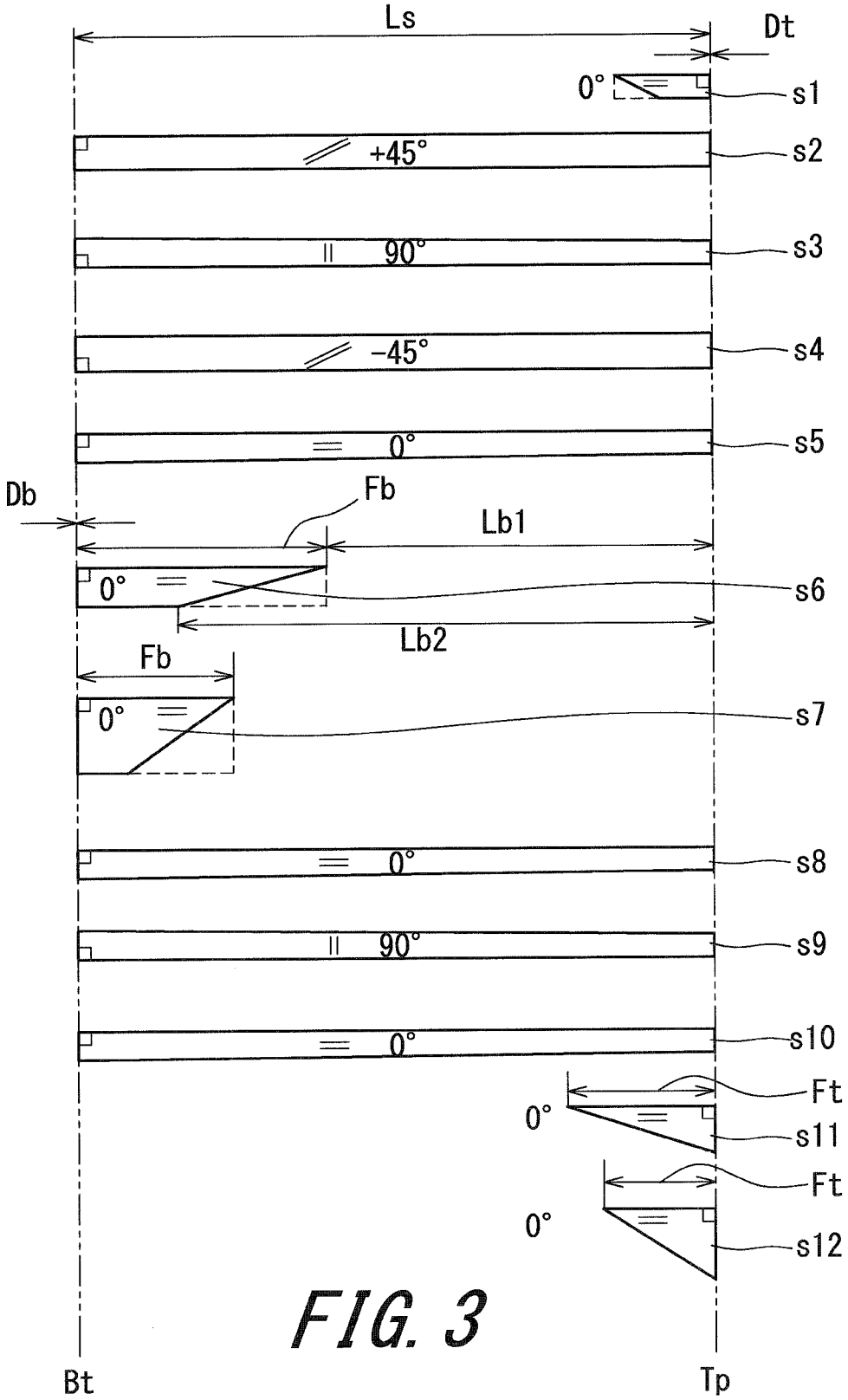
FIG. 3 is a developed view of a shaft according to a second embodiment.

FIG. 3 is a developed view showing a laminated constitution of a second embodiment. In the second embodiment, the shape of the butt partial sheet s6 is different from that of FIG. 2. The axial-direction length Fb of the butt partial sheet s6 is longer than that of the sheet s6 of the embodiment in FIG. 2. In the second embodiment, the sheet s6 has a relatively small width (circumferential-direction width), and the tip (tip end Tp side) of the sheet s6 has a relatively small angle.

Figure 4:
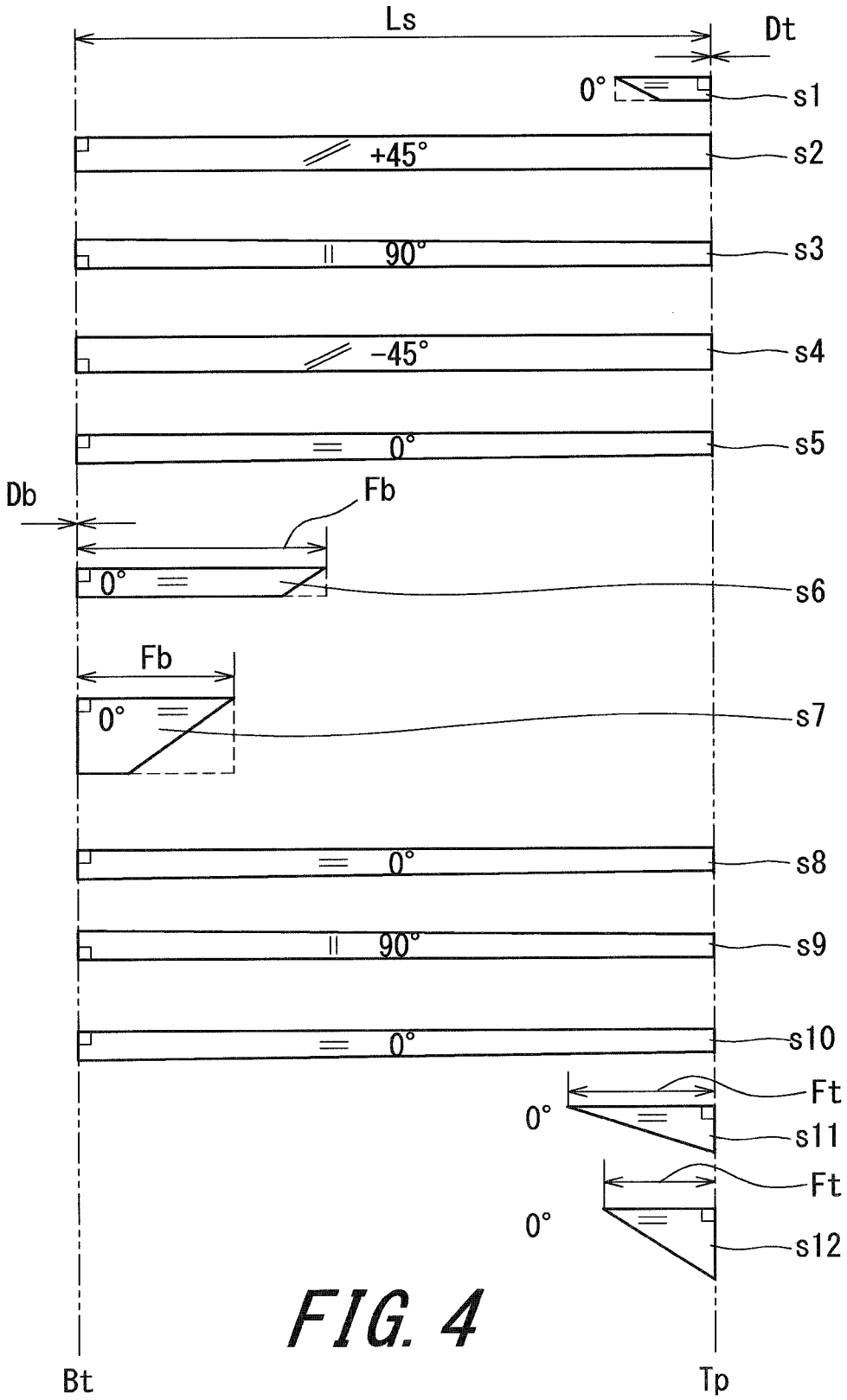
FIG. 4 is a developed view of a shaft according to a third embodiment.

FIG. 4 is a developed view showing a laminated constitution of a third embodiment. In the third embodiment, the shape of the butt partial sheet s6 is different from that of FIG. 2. The axial-direction length Fb of the butt partial sheet s6 is longer than that of the sheet s6 of the embodiment in FIG. 2. In the third embodiment, the sheet s6 has a relatively small width (circumferential-direction width), and the tip (tip end Tp side) of the sheet s6 has a relatively large angle.

Thus, in the comparison between FIG. 2, FIG. 3 and FIG. 4, the dimensions of the butt partial layer are changed. EI value at each point of the butt portion can be adjusted by changing the butt partial layer.

Figure 5:
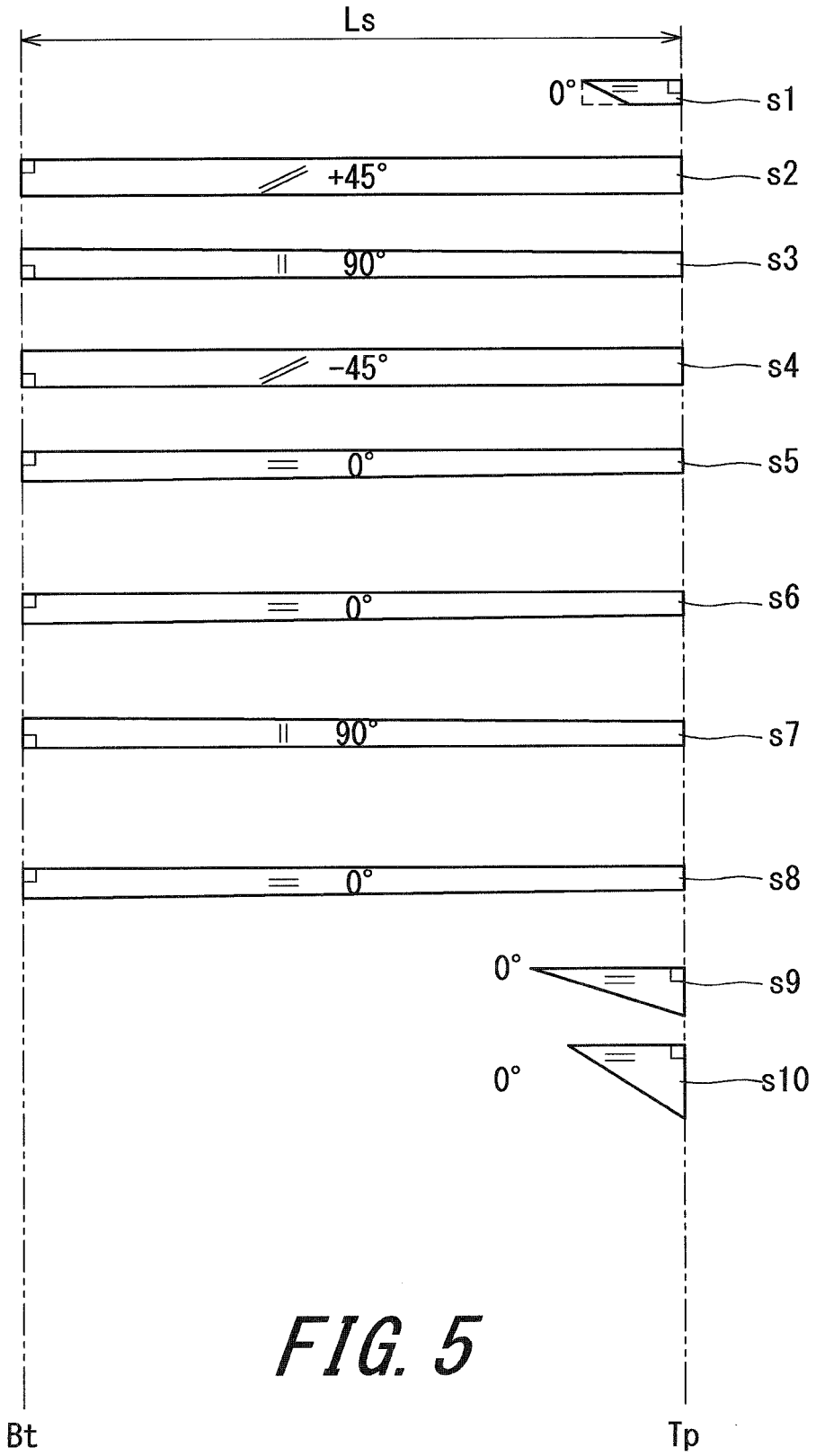
FIG. 5 is a developed view of a shaft according to a fourth embodiment.

FIG. 5 shows a laminated constitution according to a fourth embodiment. FIG. 5 is also a laminated constitution of Comparative Example 1 (to be described layer). The embodiment of FIG. 5 is constituted with ten sheets. The shaft according to FIG. 5 includes a first sheet s1 to a 10th sheet s10. The layer s1 is the tip partial straight layer. The layer s2 is the full length bias layer. The layer s3 is the full length hoop layer. The layer s4 is the full length bias layer. The layer s5 is the full length straight layer. The layer s6 is the full length straight layer. The layer s7 is the full length hoop layer. The layer s8 is the full length straight layer. The layer s9 is the tip partial straight layer. The layer s10 is the tip partial straight layer.

The embodiment of FIG. 5 does not include a butt partial layer. In the embodiment, the ratio of the center of gravity of the shaft is apt to be lowered. In the embodiment, E9/E6 and E10/E6 are apt to be lowered. In the present invention, the butt partial layer is not essential. Therefore, the shaft of the present invention may include the laminated constitution of FIG. 5. Preferably, the shaft of the present invention includes a butt partial layer.

[Measurement of EI Value]

An EI value is an index showing a flexural rigidity at each position of a shaft. In the present invention, EI values of at least ten points are measured.

Figure 6:
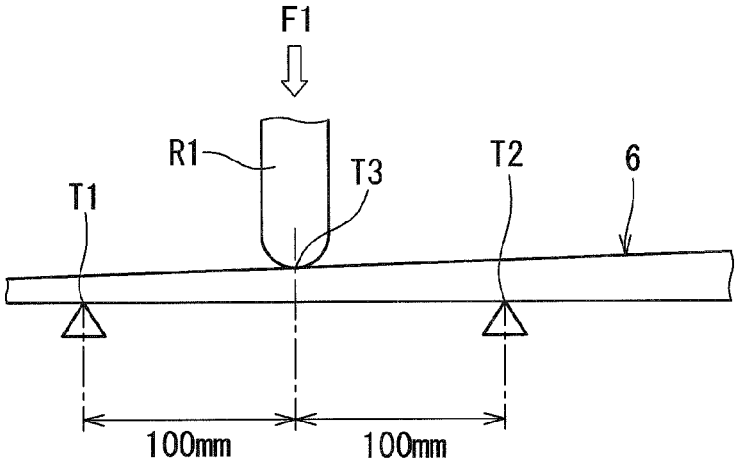
FIG. 6 is a schematic view showing a method for measuring an EI value.

FIG. 6 shows a method for measuring the EI value. EI is measured using a universal material testing machine, Type 2020 (maximum load: 500 kg) manufactured by INTESCO Co., Ltd. The shaft 6 is supported from beneath at a first support point T1 and a second support point T2. A load F1 is applied from above to a measurement point T3 while keeping the supports. The direction of the load F1 is the vertically downward direction. The distance between the point T1 and the point T2 is 200 mm. The measurement point T3 is set to a position by which the distance between the point T1 and the point T2 is divided into two equal parts. A deflection amount H generated by applying the load F1 is measured. The load F1 is applied with an indenter R1. The tip of the indenter R1 is a cylindrical surface having a curvature radius of 5 mm. A downwardly moving speed of the indenter R1 is 5 mm/min. The moving of the indenter R1 is stopped when the load F1 reaches 20 kgf (196 N), and the deflection amount H at the time is measured. The deflection amount H is the amount of displacement of the point T3 in the vertical direction. E1 is calculated by the following formula:

$$EI(\text{kgf}\cdot\text{m}^2)=F1\times L^3/(48\times H),$$

where F1 represents the maximum load (kgf), L represents the distance between the support points (m), and H represents the deflection amount (m). The maximum load F1 is 20 kgf, and the distance L between the support points is 0.2 m.

[E1 to E10]

Measurement points of EI are the following ten points.

(Measurement point 1): a point of 130 mm distant from the tip end Tp (Measurement point 2): a point of 230 mm distant from the tip end Tp (Measurement point 3): a point of 330 mm distant from the tip end Tp (Measurement point 4): a point of 430 mm distant from the tip end Tp (Measurement point 5): a point of 530 mm distant from the tip end Tp (Measurement point 6): a point of 630 mm distant from the tip end Tp (Measurement point 7): a point of 730 mm distant from the tip end Tp (Measurement point 8): a point of 830 mm distant from the tip end Tp (Measurement point 9): a point of 930 mm distant from the tip end Tp (Measurement point 10): a point of 1030 mm distant from the tip end Tp In the present application, an EI value at the measurement point 1 is defined as E1. An EI value at the measurement point 2 is defined as E2. An EI value at the measurement point 3 is defined as E3. An HI value at the measurement point 4 is defined as E4. An EI value at the measurement point 5 is defined as E5. An EI value at the measurement point 6 is defined as E6. An EI value at the measurement point 7 is defined as E7. An EI value at the measurement point 8 is defined as E8. An EI value at the measurement point 9 is defined as E9. An EI value at the measurement point 10 is defined as E10.

In the present application, a first region, a second region, and a third region are defined. The first region, the second region and the third region are regions in the axial direction.

[First Region]

A region having a distance of equal to or less than 230 mm from the tip end Tp is defined as the first region. In other words, the first region is a region between the tip end Tp and the measurement point 2. The measurement point 2 is included in the first region. Of the above described 10 measurement points, points belonging to the first region are two points, the measurement points 1 and 2. [Second Region]

A region having a distance of greater than 230 mm but less than 830 mm from the tip end Tp is the second region. Of the above described 10 measurement points, points belonging to the second region are five points, the measurement points 3 to 7.

[Third Region]

A region having a distance of equal to or greater than 830 mm from the tip end Tp is the third region. The measurement point 8 is included in the third region. Of the above described 10 measurement points, points belonging to the third region are three points, the measurement points 8 to 10.

[M1, M2, M3]

In the present application, a graph on which EI values at the 10 points are plotted is considered. The graph is an x-y coordinate plane. The x axis of the graph represents a distance (mm) between the tip end Tp and the measurement point. The y axis of the graph represents the EI value (kgf·m$^2$).

Figure 7:
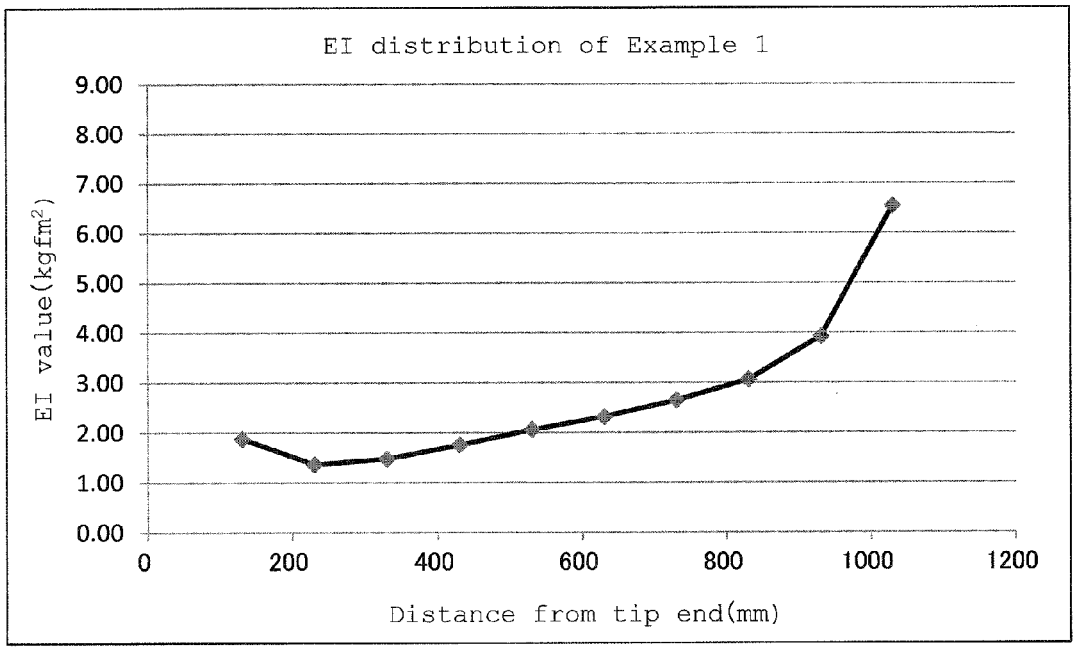
FIG. 7 is a graph showing an EI distribution of Example 1.

FIG. 7 is a graph on which E1 to E10 of Example 1 (to be described later) are plotted. As described above, the x axis (horizontal axis) of the graph represents the distance (mm) from the tip end Tp, and the y axis of the graph represents the EI value (kgf·m$^2$). Coordinates (x, y) of the ten points plotted on the graph are (130, E1), (230, E2), (330, E3), (430, E4), (530, E5), (630, E6), (730, E7), (830, E8), (930, E9) and (1030, E10). Of these coordinates, coordinates belonging to the first region are (130, E1) and (230, E2). Coordinates belonging to the second region are (330, E3), (430, E4), (530, E5), (630, E6) and (730, E7). Coordinates belonging to the third region are (830, E8), (930, E9), and (1030, E10).

In the graph, a gradient of a straight line obtained by approximating the points in the first region with the least-square method is defined as M1. However, since points belonging to the first region are two points, the least-square method may not be used. M1 is equal to the gradient of the straight line passing through the two points belonging to the first region.

Figure 8:
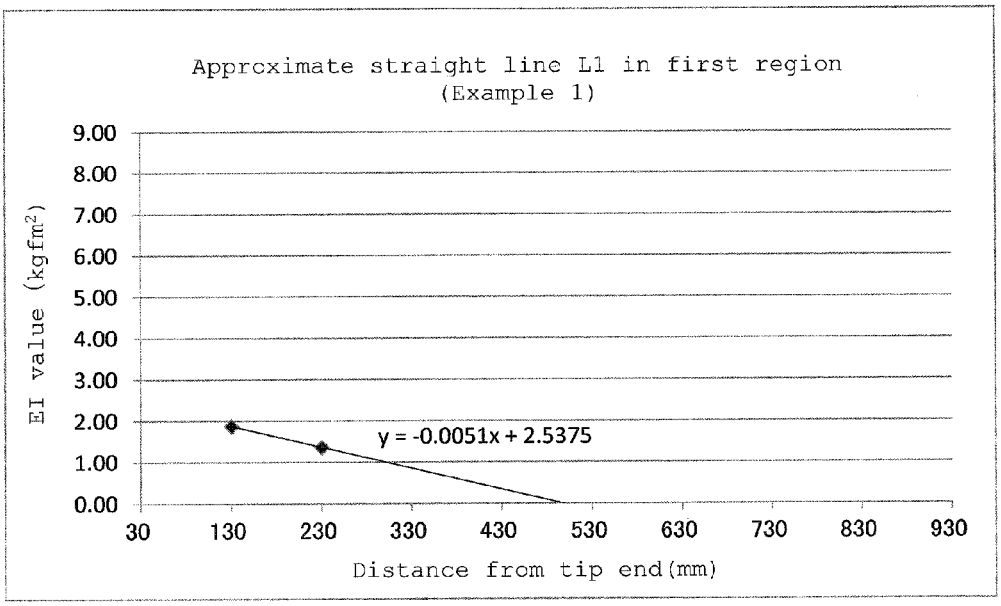
FIG. 8 is a graph showing a straight line obtained by approximating points in a first region of Example 1 with a least-square method.

FIG. 8 shows an approximate straight line L1 in the first region. The gradient of the straight line L1 is M1. As described above, measurement points belonging to the first region are the measurement points 1 and 2. Of the 10 measurement points, only two points belonging to the first region are shown in FIG. 8. As shown in FIG. 8, M1 is −0.0051. The formula of the approximate straight line L1 is "y=−0.0051x+2.5375".

In the graph, a gradient of a straight line obtained by approximating the points in the second region with the least-square method is defined as M2. The approximation for forming a straight line with the least-square method can be easily performed by using the function of "linear approximation" in the spreadsheet program "EXCEL 2010" manufactured by Microsoft Corporation. The function "LINEST" in the program may be used. The trade name "EXCEL" is a registered trademark of Microsoft Corporation.

Figure 9:
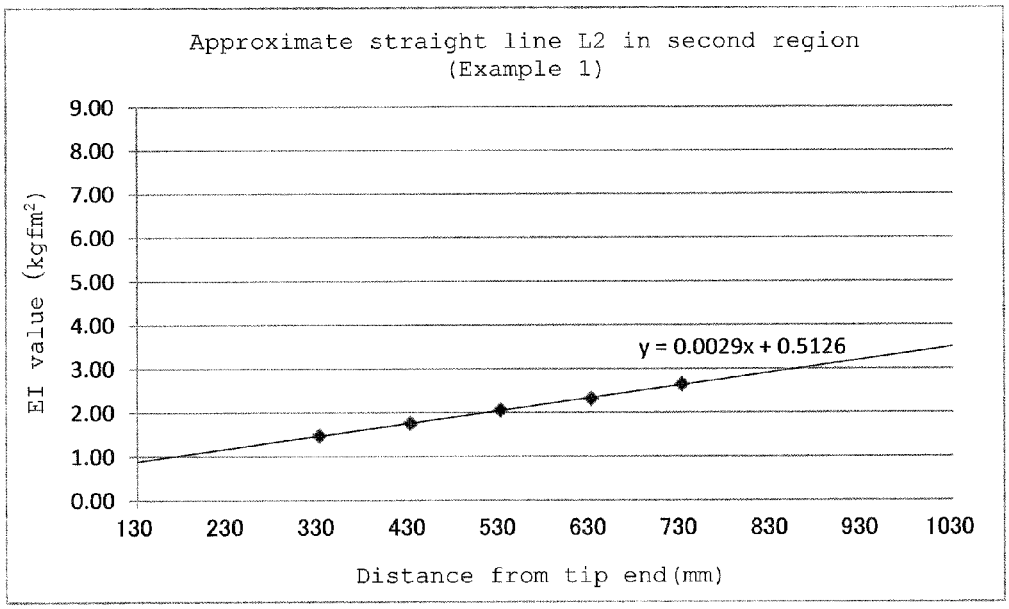
FIG. 9 is a graph showing a straight line obtained by approximating points in a second region of Example 1 with the least-square method.

FIG. 9 shows an approximate straight line L2 in the second region. The gradient of the straight line L2 is M2. As described above, measurement points belonging to the second region are the measurement points 3 to 7. Of the 10 measurement points, only the five points belonging to the second region are shown in FIG. 9. As shown in FIG. 9, M2 is 0.0029. The formula of the approximate straight line L2 is "y=0.0029x+0.5126".

In the graph, a gradient of a linear expression obtained by approximating the points in the third region with the least-square method is defined as M3.

Figure 10:
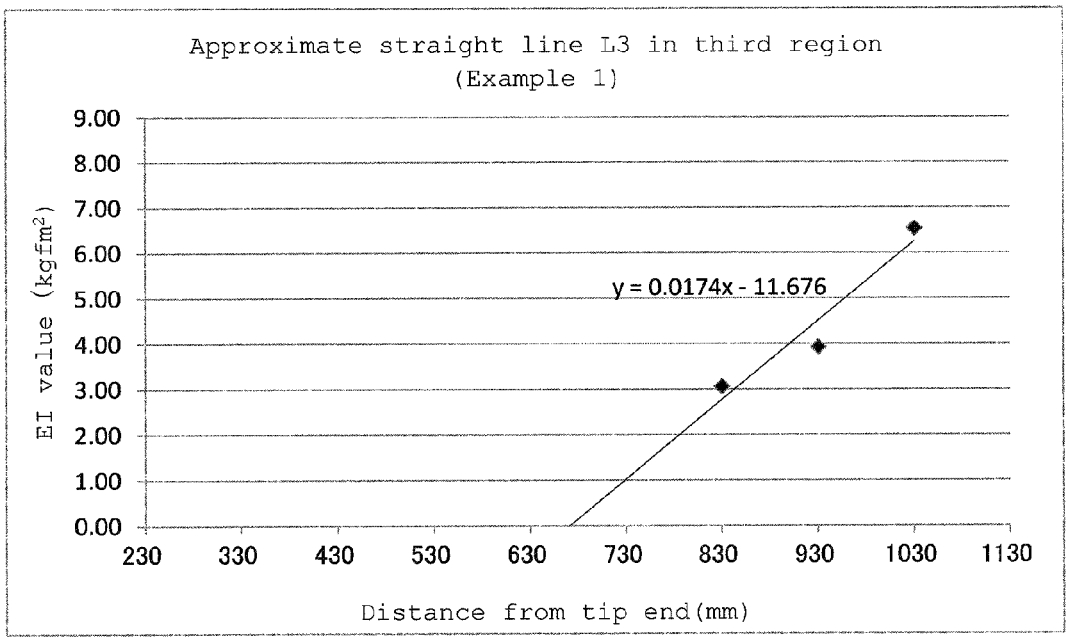
FIG. 10 is a graph showing a straight line obtained by approximating points in a third region of Example 1 with the least-square method.

FIG. 10 shows an approximate straight line L3 in the third region. The gradient of the straight line L3 is M3. As described above, measurement points belonging to the third region are the measurement points 8 to 10. Of the 10 measurement points, only three points belonging to the third region are shown in FIG. 10. As shown in FIG. 10, M3 is 0.0174. The formula of the approximate straight line L3 is "y=0.0174x−11.676".

The gradients M1, M2 and M3 preferably satisfy the following.

$$-0.015 \leq M1 \leq 0 \quad \text{(a)}$$

$$0.0008 \leq M2 \leq 0.008 \quad \text{(b)}$$

$$0.005 \leq M3 \leq 0.03 \quad \text{(c)}$$

$$M2 < M3 \quad \text{(d)}$$

That is, the gradient M1 is preferably equal to or greater than −0.015 but preferably equal to or less than 0. The gradient M2 is preferably equal to or greater than 0.0008 but preferably equal to or less than 0.008. The gradient M3 is preferably equal to or greater than 0.005 but preferably equal to or less than 0.03. M3 is preferably greater than M2.

In the shaft satisfying the above (a) to (d), an EI distribution is likely to have a middle-recessed shape. The middle-recessed shape means that the graph has a recessed shape in a middle portion of the shaft (see FIG. 7). Because of the middle-recessed shape, flexure of the shaft as a whole is secured and thereby the head speed is improved. This effect is also referred to as a middle-recessed effect.

In view of the middle-recessed shape, each point on the graph is preferably close to the approximate straight lines. In this respect, the following (1) to (10) are preferable.

(1) A distance between a point at the x coordinate of 130 mm on the straight line L1 and the point (130, E1) is equal to or less than 0.8 (kgf·m$^2$), and more preferably equal to or less than 0.4 (kgf·m$^2$).

(2) A distance between a point at the x coordinate of 230 mm on the straight line L1 and the point (230, E2) is equal to or less than 0.8 (kgf·m$^2$), and more preferably equal to or less than 0.4 (kgf·m$^2$).

(3) A distance between a point at the x coordinate of 330 mm on the straight line L2 and the point (330, E3) is equal to or less than 1.7 (kgf·m$^2$), and more preferably equal to or less than 0.85 (kgf·m$^2$).

(4) A distance between a point at the x coordinate of 430 mm on the straight line L2 and the point (430, E4) is equal to or less than 1.7 (kgf·m$^2$), and more preferably equal to or less than 0.85 (kgf·m$^2$).

(5) A distance between a point at the x coordinate of 530 mm on the straight line L2 and the point (530, E5) is equal to or less than 1.7 (kgf·m$^2$), and more preferably equal to or less than 0.85 (kgf·m$^2$).

(6) A distance between a point at the x coordinate of 630 mm on the straight line L2 and the point (630, E6) is equal to or less than 1.7 (kgf·m$^2$), and more preferably equal to or less than 0.85 (kgf·m$^2$).

(7) A distance between a point at the x coordinate of 730 mm on the straight line L2 and the point (730, E7) is equal to or less than 1.7 (kgf·m$^2$), and more preferably equal to or less than 0.85 (kgf·m$^2$).

(8) A distance between a point at the x coordinate of 830 mm on the straight line L3 and the point (830, E8) is equal to or less than 3.0 (kgf·m$^2$), and more preferably equal to or less than 1.5 (kgf-m$^2$).

(9) A distance between a point at the x coordinate of 930 mm on the straight line L3 and the point (930, E9) is equal to or less than 3.0 (kgf·m$^2$), and more preferably equal to or less than 1.5 (kgf·m$^2$).

(10) A distance between a point at the x coordinate of 1030 mm on the straight line L3 and the point (1030, E10) is equal to or less than 3.0 (kgf·m$^2$), and more preferably equal to or less than 1.5 (kgf·m$^2$). [E9/E6, E10/E6]

The present inventor has found that a head speed is improved by optimizing E9/E6 and E10/E 6. The reason lies in the path of the head. It has been found that, because of the optimization, the head is apt to take an inside path in the initial phase of a downswing. The word "inside" means a side close to a swing axis. A moment of inertia of a club about a swing axis in an actual swing is substantially decreased by the inside path of the head. For this reason, easiness of swing is enhanced and the head speed is improved. This effect is also referred to as an inside-path effect.

In the initial phase of a downswing (immediately after a turn from the top), a flexural stress is applied particularly to the butt side (grip side) of the shaft. By increasing E9/E6 and E10/E6, the concentration of the stress is promoted to increase flexure of the butt portion in the initial phase of a downswing. The increase of flexure enhances the inside-path effect. In addition, by optimizing E9/E6 and E10/E6, the middle-recessed effect is also enhanced. The synergistic effect of the inside-path effect and the middle-recessed effect can further improve the head speed.

In light of the middle-recessed effect and the inside-path effect, E9/E6 is preferably equal to or greater than 1.7, more preferably equal to or greater than 1.8, and still more preferably equal to or greater than 1.9. If E9 is excessively large, the inside-path effect can be deteriorated. In this respect, E9 /E6 is preferably equal to or less than 3.0, more preferably equal to or less than 2.8, and still more preferably equal to or less than 2.6.

In light of the middle-recessed effect and the inside-path effect, E10/E6 is preferably equal to or greater than 2.0, more preferably equal to or greater than 2.1, and still more preferably equal to or greater than 2.2. If E10 is excessively large, the inside-path effect can be deteriorated. In this respect, E10/E6 is preferably equal to or less than 4.0, more preferably equal to or less than 3.5, still more preferably equal to or less than 3.3, and yet still more preferably equal to or less than 3.1.

In light of increasing flexure of the butt portion in the initial phase of a downswing, a difference between E10 and E9 is preferably great. By increasing the flexure of the butt portion, the inside-path effect is enhanced. Considering this point, the difference (E10-E9) is preferably equal to or greater than 1.0 (kgf·m$^2$), more preferably equal to or greater than 1.5 (kgf·m$^2$), still more preferably equal to or greater than 1.8 (kgf·m$^2$), and yet still more preferably equal to or greater than 1.9 (kgf·m$^2$). If E10 is excessively large, feeling might be deteriorated. In this respect, the difference (E10-E9) is preferably equal to or less than 5.0 (kgf·m$^2$), and more preferably equal to or less than 4.0 (kgf·m$^2$).

In light of the middle-recessed effect and the inside-path effect, the gradient M3 is preferably equal to or greater than 0.005, more preferably equal to or greater than 0.007, still more preferably equal to or greater than 0.01, still more preferably equal to or greater than 0.013, still more preferably equal to or greater than 0.015, and yet still more preferably equal to or greater than 0.017. In light of the inside-path effect, the gradient M3 is preferably equal to or less than 0.03, more preferably equal to or less than 0.025, still more preferably equal to or less than 0.023, and yet still more preferably equal to or less than 0.020.

In light of the middle-recessed effect and the inside-path effect, M3/M2 is preferably equal to or greater than 3, more preferably equal to or greater than 4, and still more preferably equal to or greater than 5. In light of the inside-path effect, M3/M2 is preferably equal to or less than 12, more preferably equal to or less than 11, and still more preferably equal to or less than 10.

In addition, since the ratio of the center of gravity of the shaft is high, easiness of swing is achieved. This enables further improvement of the head speed.

As described above, a low-elastic layer is used for the butt partial layer s6. Therefore, an excessive rigidity of the butt portion is suppressed. Thus, flexure of the butt portion is obtained to enhance the inside-path effect. Furthermore, the butt partial layer s6 contributes to increase in the ratio of the center of gravity of the shaft.

By adopting the low-elastic layer as the butt partial layer, feeling at hitting can be improved. In addition, since the middle-recessed effect and the inside-path effect produce a favorable flexure, it is considered that those effects also contribute to improvement of feeling.

A double-pointed arrow Lb1 in FIG. 3 shows a minimum distance between the end at the tip side of the butt partial layer and the tip end Tp. In the embodiment of FIG. 3, the end at the tip side of the butt partial sheet s6 forms an oblique side. The minimum distance Lb1 is the minimum value of the distance between the oblique side and the tip end Tp.

In light of the middle-recessed effect, the position of the end at the tip side of the butt partial layer is important. In addition, in light of the inside-path effect, it is preferable that, in a downswing, the flexural stress is concentrated on a specified position in a grip portion of the shaft. In these respects, neither an excessively great distance Lb1 nor an excessively small distance Lb1 is preferable. Specifically, the distance Lb1 is preferably equal to or greater than 800 mm, more preferably equal to or greater than 820 mm, and still more preferably equal to or greater than 840 mm. The distance Lb1 is preferably equal to or less than 970 mm, more preferably equal to or less than 950 mm, and still more preferably equal to or less than 930 mm. It is preferable that at least one butt partial layer satisfies the preferable distance Lb1, and it is more preferable that the butt partial layer that is the low-elastic layer satisfies the preferable distance Lb1.

A double-pointed arrow Lb2 in FIG. 3 shows a maximum distance between the end at the tip side of the butt partial layer and the tip end Tp. In the embodiment of FIG. 3, the end at the tip side of the butt partial sheet s6 forms the oblique side. The maximum distance Lb2 is the maximum value of the distance between the oblique side and the tip end Tp.

In light of the middle-recessed effect, the position of the end at the tip side of the butt partial layer is important. In addition, in light of the inside-path effect, it is preferable that, in a downswing, the flexural stress is concentrated on a specified position in the grip portion of the shaft. In these respects, neither an excessively great distance Lb2 nor an excessively small distance Lb2 is preferable. Specifically, the distance Lb2 is preferably equal to or greater than 930 mm, more preferably equal to or greater than 950 mm, and still more preferably equal to or greater than 970 mm. The distance Lb2 is preferably equal to or less than 1100 mm, more preferably equal to or less than 1080 mm, and still more preferably equal to or less than 1060 mm. It is preferable that at least one butt partial layer satisfies the preferable distance Lb2, and it is more preferable that the butt partial layer that is the low-elastic layer satisfies the preferable distance Lb2.

If the flexural rigidity is sharply changed, feeling is deteriorated. In this respect, a difference (Lb2−Lb1) is preferably equal to or greater than 50 mm, more preferably equal to or greater than 70 mm, and still more preferably equal to or greater than 90 mm. If the difference (Lb2−Lb1) is excessively large, the middle-recessed effect is decreased to deteriorate feeling. In this respect, the difference (Lb2−Lb1) is preferably equal to or less than 200 mm, more preferably equal to or less than 180 mm, and still more preferably equal to or less than 160 mm.

In light of enhancing the effect of the position of the center of gravity of the shaft, a shaft length Ls is preferably equal to or greater than 1079 mm, more preferably equal to or greater than 1105 mm, still more preferably equal to or greater than 1130 mm, and yet still more preferably equal to or greater than 1143 mm. Considering the rule, the shaft length Ls is preferably equal to or less than 1181 mm.

In light of easiness of swing, a shaft weight is preferably equal to or less than 50 g, more preferably equal to or less than 48 g, and still more preferably equal to or less than 46 g. In light of the strength, the shaft weight is preferably equal to or greater than 30 g, more preferably equal to or greater than 33 g, and still more preferably equal to or greater than 35 g.

If the butt partial layer is provided in a lightweight shaft, the strength of the tip portion is likely to be deteriorated. In the embodiment of FIG. 2, the tip partial layer s1 is the glass fiber reinforced layer. As described above, the compressive breaking strain of the glass fiber is great. The glass fiber reinforced layer is effective in improvement of the impact-absorbing energy. An impact strength of the tip portion is improved by adopting the glass fiber reinforced layer as the tip partial layer.

Examples of the matrix resin of the prepreg sheet include a thermosetting resin and a thermoplastic resin. In respect of strength of the shaft, the matrix resin is preferably an epoxy resin.

Examples of design items for adjusting the gradients M1, M2 and M3 include the following (a1) to (a8).

(a1) a taper ratio of the shaft (mandrel)
(a2) an axial-direction length of the tip partial layer
(a3) a thickness of the tip partial layer
(a4) a fiber elastic modulus of the tip partial layer
(a5) an axial-direction length of the butt partial layer
(a6) a thickness of the butt partial layer
(a7) a fiber elastic modulus of the butt partial layer
(a8) an axial-direction position of a partial layer Examples of design items for adjusting E9/E6 and E10/E6 include the following (b1) to (b5).

(b1) a taper ratio of the shaft (mandrel)
(b2) an axial-direction length of the tip partial layer
(b3) a thickness of the tip partial layer
(b4) a fiber elastic modulus of the tip partial layer
(b5) an axial-direction position of a partial layer Examples of means for adjusting the ratio of the center of gravity of the shaft include the following (c1) to (c6).

(c1) a thickness of the butt partial layer
(c2) an axial-direction length of the butt partial layer
(c3) a thickness of the tip partial layer
(c4) an axial-direction length of the tip partial layer
(c5) a taper ratio of the shaft (mandrel)
(c6) a shape of each sheet The following tables 1 and 2 show examples of utilizable prepregs. These prepregs are commercially available. Appropriate prepregs can be selected to obtain desired specifications.

TABLE 1

Examples of utilizable prepregs

| | | | | | Physical property value of reinforcement fiber | | |
|---|---|---|---|---|---|---|---|
| Manufacturer | Trade name | Thickness of sheet (mm) | Fiber content (% by weight) | Resin content (% by weight) | Part number of fiber | Tensile elastic modulus (t/mm$^2$) | Tensile strength (kgf/mm$^2$) |
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 2255S-10 | 0.082 | 76 | 24 | T800S | 30 | 600 |

TABLE 1-continued

| Examples of utilizable prepregs | | | | | | | |
|---|---|---|---|---|---|---|---|
| | | | | | Physical property value of reinforcement fiber | | |
| Manufacturer | Trade name | Thickness of sheet (mm) | Fiber content (% by weight) | Resin content (% by weight) | Part number of fiber | Tensile elastic modulus ($t/mm^2$) | Tensile strength ($kgf/mm^2$) |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |
| Toray Industries, Inc. | 805S-3 | 0.034 | 60 | 40 | M30S | 30 | 560 |
| Toray Industries, Inc. | 8053S-3 | 0.028 | 70 | 30 | M30S | 30 | 560 |
| Toray Industries, Inc. | 9255S-7A | 0.056 | 78 | 22 | M40S | 40 | 470 |
| Toray Industries, Inc. | 9255S-6A | 0.047 | 76 | 24 | M40S | 40 | 470 |
| Toray Industries, Inc. | 925AS-4C | 0.038 | 65 | 35 | M40S | 40 | 470 |
| Toray Industries, Inc. | 9053S-4 | 0.027 | 70 | 30 | M40S | 40 | 470 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |

The tensile strength and the tensile elastic modulus are measured in accordance with "Testing Method for Carbon Fibers" JIS R7601: 1986.

TABLE 2

| Examples of utilizable prepregs | | | | | | | |
|---|---|---|---|---|---|---|---|
| | | | | | Physical property value of reinforcement fiber | | |
| Manufacturer | Trade name | Thickness of sheet (mm) | Fiber content (% by weight) | Resin content (% by weight) | Part number of fiber | Tensile elastic modulus ($t/mm^2$) | Tensile strength ($kgf/mm^2$) |
| Mitsubishi Rayon Co., Ltd. | GE352H-160S | 0.150 | 65 | 35 | E glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | TR350C-175S | 0.147 | 75 | 25 | TR50S | 24 | 500 |
| Mitsubishi Rayon Co., Ltd. | MR350J-025S | 0.034 | 63 | 37 | MR40 | 30 | 450 |
| Mitsubishi Rayon Co., Ltd. | MR350J-050S | 0.058 | 63 | 37 | MR40 | 30 | 450 |
| Mitsubishi Rayon Co., Ltd. | MR350C-050S | 0.05 | 75 | 25 | MR40 | 30 | 450 |
| Mitsubishi Rayon Co., Ltd. | MR350C-075S | 0.063 | 75 | 25 | MR40 | 30 | 450 |
| Mitsubishi Rayon Co., Ltd. | MRX350C-075R | 0.063 | 75 | 25 | MR40 | 30 | 450 |

TABLE 2-continued

| Examples of utilizable prepregs | | | | | | | |
|---|---|---|---|---|---|---|---|
| | | | | | Physical property value of reinforcement fiber | | |
| Manufacturer | Trade name | Thickness of sheet (mm) | Fiber content (% by weight) | Resin content (% by weight) | Part number of fiber | Tensile elastic modulus ($t/mm^2$) | Tensile strength ($kgf/mm^2$) |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

The tensile strength and the tensile elastic modulus are measured in accordance with "Testing Method for Carbon Fibers" JIS R7601: 1986.

EXAMPLES

Hereinafter, the effects of the present invention will be clarified by examples. However, the present invention should not be interpreted in a limited way based on the description of examples.

Example 1

A shaft having the laminated constitution shown in FIG. 2 was produced. The shaft of Example 1 was obtained in the same manner as in the manufacturing process of the shaft 6. The shaft full length Ls was 1142 mm. Specifications were adjusted by using the above described design items. Prepregs used for the sheets were as follows.

- Sheet s1: A glass fiber reinforced prepreg (having a fiber elastic modulus of 7 $tf/mm^2$)
- Sheet s2: A carbon fiber reinforced prepreg (having a fiber elastic modulus of 40 $tf/mm^2$)
- Sheet s3: A carbon fiber reinforced prepreg (having a fiber elastic modulus of 30 $tf/mm^2$)
- Sheet s4: A carbon fiber reinforced prepreg (having a fiber elastic modulus of 40 $tf/mm^2$)
- Sheet s5: A carbon fiber reinforced prepreg (having a fiber elastic modulus of 24 $tf/mm^2$)
- Sheet s6: A glass fiber reinforced prepreg (having a fiber elastic modulus of 7 $tf/mm^2$)
- Sheet s7: A carbon fiber reinforced prepreg (having a fiber elastic modulus of 24 $tf/mm^2$)
- Sheet s8: A carbon fiber reinforced prepreg (having a fiber elastic modulus of 30 $tf/mm^2$)
- Sheet s9: A carbon fiber reinforced prepreg (having a fiber elastic modulus of 30 $tf/mm^2$)
- Sheet s10: A carbon fiber reinforced prepreg (having a fiber elastic modulus of 24 $tf/mm^2$)
- Sheet s11: A carbon fiber reinforced prepreg (having a fiber elastic modulus of 24 $tf/mm^2$)
- Sheet s12: A carbon fiber reinforced prepreg (having a fiber elastic modulus of 24 $tf/mm^2$)

Ten EI values of Example 1 are shown in Table 3 below. The EI distribution of Example 1 is shown in FIG. 7.

Example 2

Figure 11:
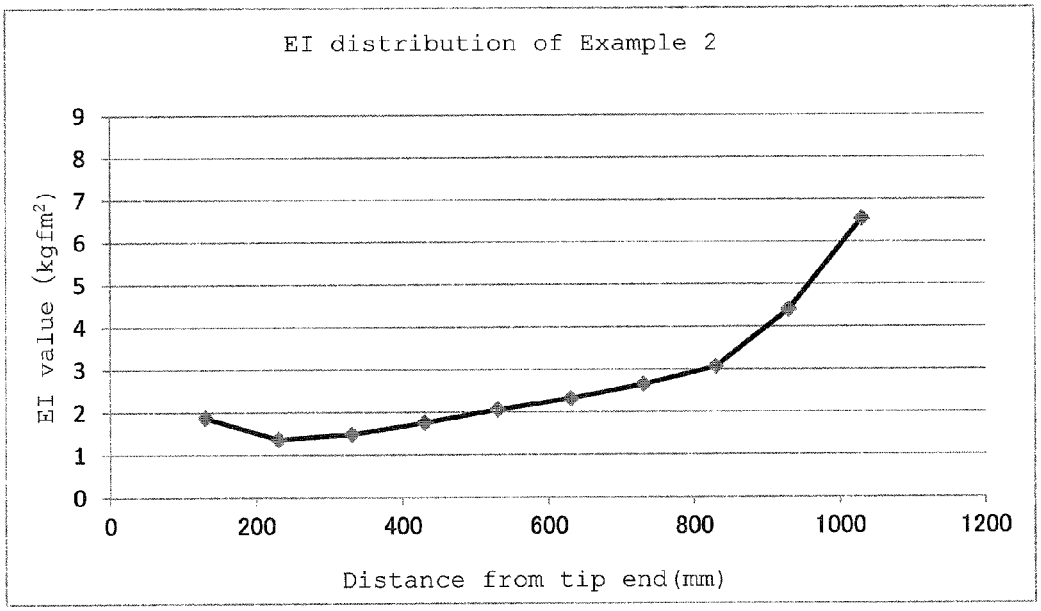
FIG. 11 is a graph showing an EI distribution of Example 2.

The shaft of Example 2 was obtained in the same manner as in Example 1 except that the laminated constitution shown in FIG. 3 was adopted. Ten EI values of Example 2 are shown in Table 4 below. The EI distribution of Example 2 is shown in FIG. 11.

Example 3

Figure 12:
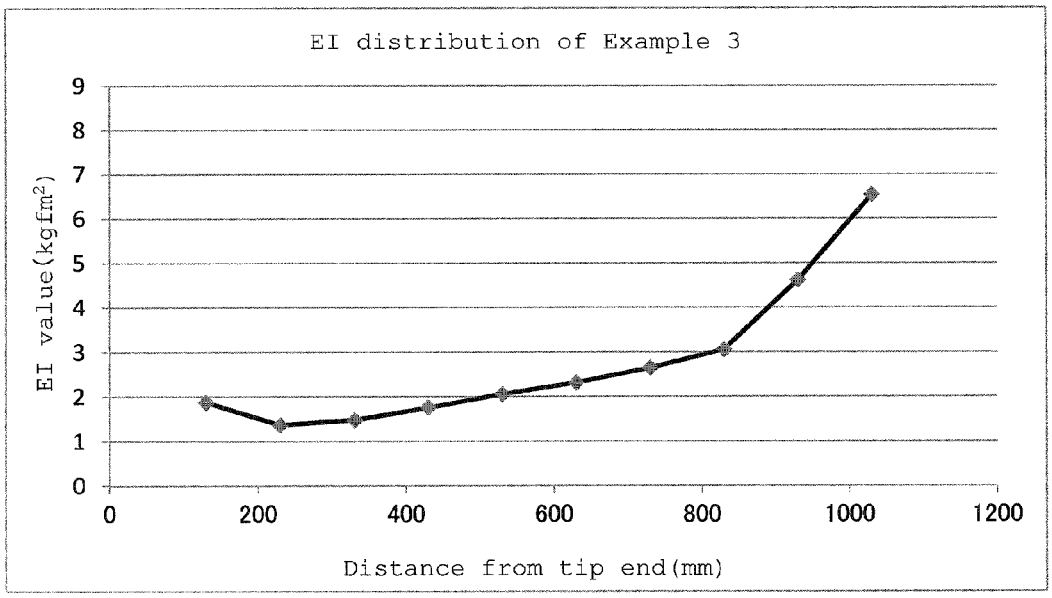
FIG. 12 is a graph showing an EI distribution of Example 3.

The shaft of Example 3 was obtained in the same manner as in Example 1 except that the laminated constitution shown in FIG. 4 was adopted. Ten EI values of Example 3 are shown in Table 5 below. The EI distribution of Example 3 is shown in FIG. 12.

Example 4

Figure 13:
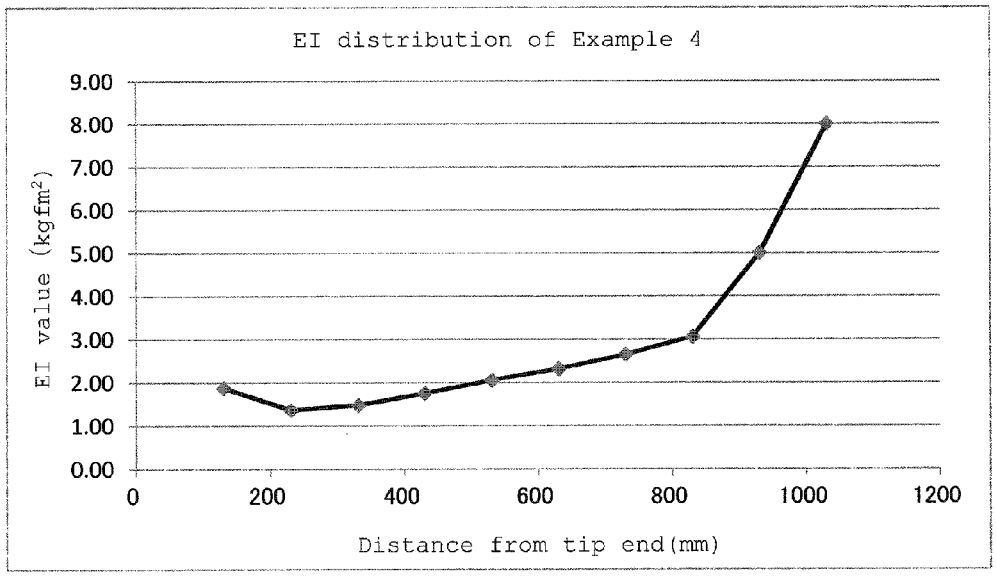
FIG. 13 is a graph showing an EI distribution of Example 4.

The butt partial layer s6 was changed to a carbon fiber reinforced layer from the glass fiber reinforced layer. The fiber elastic modulus of the butt partial layer s6 was set to 24 $tf/mm^2$. Except for these conditions, the shaft of Example 4 was obtained in the same manner as in Example 1. Ten EI values of Example 4 are shown in Table 6 below. The EI distribution of Example 4 is shown in FIG. 13.

Example 5

Figure 14:
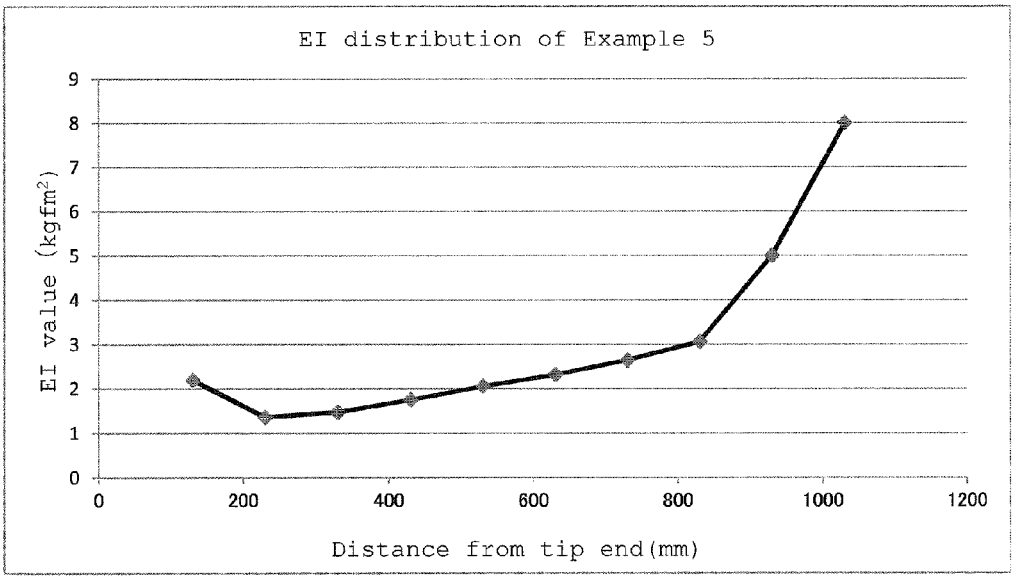
FIG. 14 is a graph showing an EI distribution of Example 5.

The tip partial layer s1 and the butt partial layer s6 were changed to carbon fiber reinforced layers from glass fiber reinforced layers, respectively. The fiber elastic modulus of the tip partial layer s1 was set to 24 $tf/mm^2$. The fiber elastic modulus of the butt partial layer s6 was set to 24 $tf/mm^2$. Except for these conditions, the shaft of Example 5 was obtained in the same manner as in Example 1. Ten EI values of Example 5 are shown in Table 7 below. The EI distribution of Example 5 is shown in FIG. 14.

Comparative Example 1

The laminated constitution shown in FIG. 5 was adopted. A shaft of Comparative Example 1 was obtained in the same manufacturing method as in the shaft 6. Specifications were adjusted by using the above described design items. Prepregs used for the sheets were as follows.

Sheet s1: A carbon fiber reinforced prepreg (having a fiber elastic modulus of 24 tf/mm$^2$)

Sheet s2: A carbon fiber reinforced prepreg (having a fiber elastic modulus of 40 tf/mm$^2$)

Sheet s3: A carbon fiber reinforced prepreg (having a fiber elastic modulus of 30 tf/mm$^2$)

Sheet s4: A carbon fiber reinforced prepreg (having a fiber elastic modulus of 40 tf/mm$^2$)

Sheet s5: A carbon fiber reinforced prepreg (having a fiber elastic modulus of 24 tf/mm$^2$)

Sheet s6: A carbon fiber reinforced prepreg (having a fiber elastic modulus of 30 tf/mm$^2$)

Sheet s7: A carbon fiber reinforced prepreg (having a fiber elastic modulus of 30 tf/mm$^2$)

Sheet s8: A carbon fiber reinforced prepreg (having a fiber elastic modulus of 24 tf/mm$^2$)

Sheet s9: A carbon fiber reinforced prepreg (having a fiber elastic modulus of 24 tf/mm$^2$)

Sheet s10: A carbon fiber reinforced prepreg (having a fiber elastic modulus of 24 tf/mm$^2$)

Figure 15:
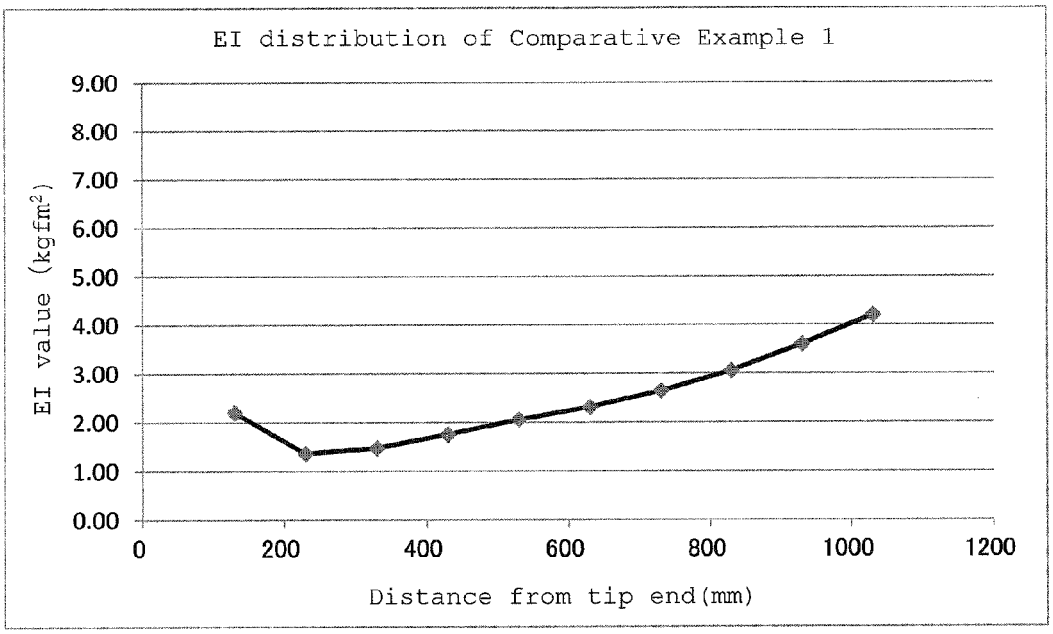
FIG. 15 is a graph showing an EI distribution of Comparative Example 1.

Ten EI values of Comparative Example 1 are shown in Table 8 below. The EI distribution of Comparative Example 1 is shown in FIG. 15.

Specifications and results of evaluations for Examples 1 to 5 and Comparative Example 1 are shown in Table 9 below.

TABLE 3

EI values of Example 1

| | Distance from the tip end (mm) | EI value (kgf · m$^2$) |
|---|---|---|
| E1 | 130 | 1.87 |
| E2 | 230 | 1.36 |
| E3 | 330 | 1.48 |
| E4 | 430 | 1.75 |
| E5 | 530 | 2.06 |
| E6 | 630 | 2.31 |
| E7 | 730 | 2.65 |
| E8 | 830 | 3.06 |
| E9 | 930 | 3.92 |
| E10 | 1030 | 6.54 |
| E9/E6 | — | 1.69 |
| E10/E6 | — | 2.82 |
| E10 − E9 | — | 2.62 |

TABLE 4

EI values of Example 2

| | Distance from the tip end (mm) | EI value (kgf · m$^2$) |
|---|---|---|
| E1 | 130 | 1.87 |
| E2 | 230 | 1.36 |
| E3 | 330 | 1.48 |
| E4 | 430 | 1.75 |
| E5 | 530 | 2.06 |
| E6 | 630 | 2.31 |
| E7 | 730 | 2.65 |
| E8 | 830 | 3.06 |
| E9 | 930 | 4.40 |
| E10 | 1030 | 6.54 |
| E9/E6 | — | 1.90 |
| E10/E6 | — | 2.83 |
| E10 − E9 | — | 2.14 |

TABLE 5

EI values of Example 3

| | Distance from the tip end (mm) | EI value (kgf · m$^2$) |
|---|---|---|
| E1 | 130 | 1.87 |
| E2 | 230 | 1.36 |
| E3 | 330 | 1.48 |
| E4 | 430 | 1.75 |
| E5 | 530 | 2.06 |
| E6 | 630 | 2.31 |
| E7 | 730 | 2.65 |
| E8 | 830 | 3.06 |
| E9 | 930 | 4.62 |
| E10 | 1030 | 6.54 |
| E9/E6 | — | 2.00 |
| E10/E6 | — | 2.83 |
| E10 − E9 | — | 1.92 |

TABLE 6

EI values of Example 4

| | Distance from the tip end (mm) | EI value (kgf · m$^2$) |
|---|---|---|
| E1 | 130 | 1.87 |
| E2 | 230 | 1.36 |
| E3 | 330 | 1.48 |
| E4 | 430 | 1.75 |
| E5 | 530 | 2.06 |
| E6 | 630 | 2.31 |
| E7 | 730 | 2.65 |
| E8 | 830 | 3.06 |
| E9 | 930 | 5.00 |
| E10 | 1030 | 8.00 |
| E9/E6 | — | 2.16 |
| E10/E6 | — | 3.46 |
| E10 − E9 | — | 3.00 |

TABLE 7

EI values of Example 5

| | Distance from the tip end (mm) | EI value (kgf · m$^2$) |
|---|---|---|
| E1 | 130 | 2.20 |
| E2 | 230 | 1.36 |
| E3 | 330 | 1.48 |
| E4 | 430 | 1.75 |
| E5 | 530 | 2.06 |
| E6 | 630 | 2.31 |
| E7 | 730 | 2.65 |
| E8 | 830 | 3.06 |
| E9 | 930 | 5.00 |
| E10 | 1030 | 8.00 |
| E9/E6 | — | 2.16 |
| E10/E6 | — | 3.46 |
| E10 − E9 | — | 3.00 |

TABLE 8

EI values of Comparative Example 1

| | Distance from the tip end (mm) | EI value (kgf · m$^2$) |
|---|---|---|
| E1 | 130 | 2.20 |
| E2 | 230 | 1.36 |
| E3 | 330 | 1.48 |
| E4 | 430 | 1.75 |
| E5 | 530 | 2.06 |

TABLE 8-continued

| EI values of Comparative Example 1 | | |
|---|---|---|
| | Distance from the tip end (mm) | EI value (kgf · m$^2$) |
| E6 | 630 | 2.31 |
| E7 | 730 | 2.65 |
| E8 | 830 | 3.06 |
| E9 | 930 | 3.60 |
| E10 | 1030 | 4.20 |
| E9/E6 | — | 1.56 |
| E10/E6 | — | 1.81 |
| E10 − E9 | — | 0.60 |

TABLE 9

| Specifications and results of evaluations for Examples and Comparative Examples | | | | | | | |
|---|---|---|---|---|---|---|---|
| | Ex. 1 | Ex. 2 | Ex. 3 | Ex. 4 | Ex. 5 | Comp. Ex. 1 | Comp. Ex. 2 |
| Shaft weight (g) | 44 | 44 | 44 | 44 | 44 | 44 | 44 |
| Ratio of the center of gravity of the shaft | 0.57 | 0.55 | 0.54 | 0.54 | 0.54 | 0.53 | 0.53 |
| E9/E6 | 1.7 | 1.9 | 2.0 | 2.2 | 2.2 | 1.6 | 1.6 |
| E10/E6 | 2.8 | 2.8 | 2.8 | 3.5 | 3.5 | 1.8 | 1.8 |
| Existence or non-existence of the low-elastic butt partial layer | exist | exist | exist | not exist | not exist | not exist | not exist |
| Existence or non-existence of the sandwich structure | exist | exist | exist | exist | exist | exist | not exist |
| Existence or non-existence of the low-elastic tip partial layer | exist | exist | exist | exist | not exist | not exist | not exist |
| Gradient M1 of the approximate line | −0.0051 | −0.0051 | −0.0051 | −0.0102 | −0.0084 | −0.0084 | −0.0084 |
| Gradient M2 of the approximate line | 0.0029 | 0.0029 | 0.0029 | 0.0029 | 0.0029 | 0.0029 | 0.0029 |
| Gradient M3 of the approximate line | 0.0174 | 0.0174 | 0.0174 | 0.0247 | 0.0247 | 0.0057 | 0.0057 |
| Strength at T point (kgf) | 220 | 220 | 220 | 220 | 210 | 190 | 180 |
| Strength at B point (kgf) | 75 | 75 | 75 | 75 | 75 | 65 | 60 |
| Strength at C point (kgf) | 150 | 150 | 150 | 160 | 160 | 130 | 125 |
| Distance of inside-path (mm) | 10 | 8 | 6 | 3 | 3 | 0 | 0 |
| Head speed (m/s) | 38 | 37.8 | 37.6 | 37.3 | 37.3 | 36.8 | 36.8 |
| Feeling (maximum scale of 5 points) | 4.5 | 4 | 4 | 3.5 | 3.5 | 3 | 3 |

Methods for the evaluations are as follows.

[Three-Point Flexural Strength]

Three-point flexural strength was measured in accordance with an SG type three-point flexural strength test. This is a test set by Japan's Consumer Product Safety Association. Measurement points were set to a point T, a point B, and a point C. The point T is a point 90 mm distant from the tip end Tp. The point B is a point 525 mm distant from the tip end Tp. The point C is a point 175 mm distant from the butt end Bt.

Figure 16:
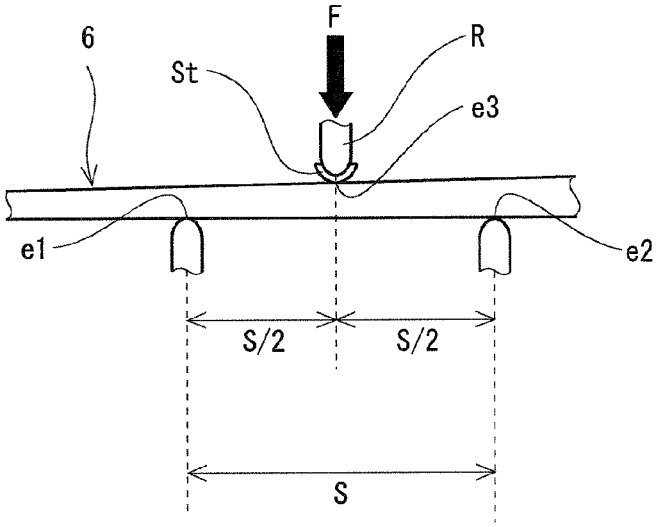
FIG. 16 is a schematic view showing a method for measuring a three-point flexural strength.

FIG. 16 shows a method for measuring the three-point flexural strength. As shown in FIG. 16, a load F is downwardly applied with an indenter R from above to a load point e3 while a shaft 6 is being supported from beneath at two supporting points e1 and e2. The descending speed of the indenter R is 20 mm/min. A silicone rubber St was attached to the tip of the indenter R. The position of the load point e3 is set to a position by which a distance between the support points e1 and e2 is divided into two equal parts. The load point e3 is the measurement point. When the point T is measured, a span S is set to 150 mm. When the points B and C are measured, the span S is set to 300 mm. A value (peak value) of the load F when the shaft 6 was broken was measured. Values of the load F are shown in the above Table 9.

[Distance of Inside-Path]

For confirming the inside-path effect, the distance of the inside-path was measured. A head and a grip were attached to each shaft to obtain golf clubs. A driver head (loft 10.5 degrees), the trade name "XXIO EIGHT" manufactured by Dunlop Sports Co., Ltd., was used as the head. Photographs of swings were taken from the front of the golf player to obtain head paths. How far inside the head paths were during downswing based on the path of Comparative Example 1 were measured. The two paths were overlaid with one another by image processing to measure the distance between the two paths. The maximum value of the distances was adopted as the distance of the inside-path. The average scores of ten golf players are shown in the above Table 9.

[Feeling]

The ten golf players actually hit balls with the golf clubs and evaluated the feelings. The feeling was defined as an overall evaluation of feel in hitting and easiness of swing. Sensuous evaluation was made on a scale of one to five. The higher the score is, the higher the evaluation is. The average scores of the ten golf players are shown in the above Table 9.

Comparative Example 2

Figure 17:
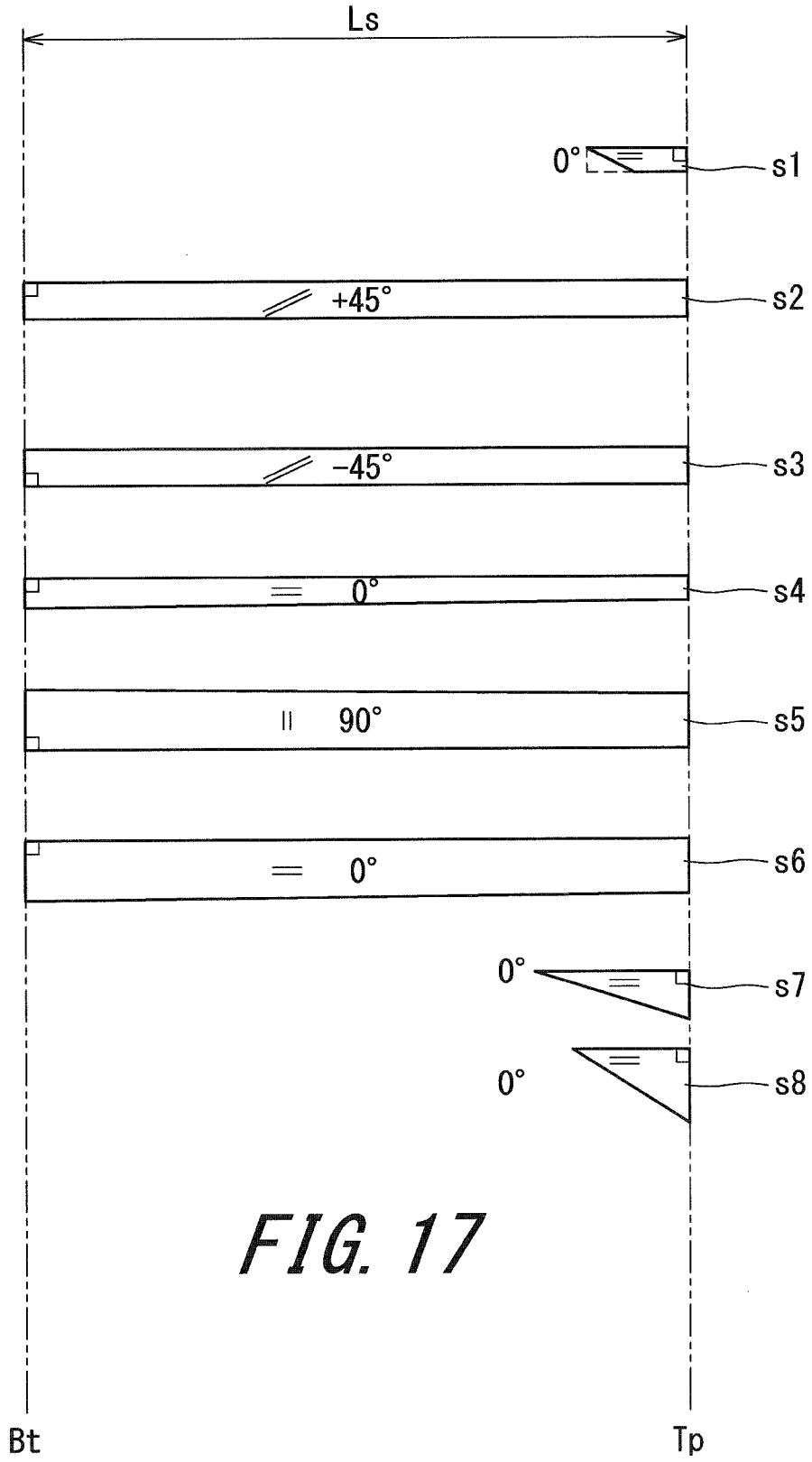
FIG. 17 is a developed view of a shaft according to Comparative Example 2.

Comparative Example 2 was produced as a shaft not having the sandwich structure. The laminated constitution of Comparative Example 2 is shown in FIG. 17. In Comparative Example 2, the first hoop sheet s3 (one ply) and the second hoop sheet s7 (one ply) in Comparative Example 1 (FIG. 5) were unified to one hoop sheet s5 (two plies). In addition, in Comparative Example 2, two straight sheets s6 (one ply) and s8 (one ply) in Comparative Example 1 (FIG. 5) were unified to one straight sheet s6 (two plies). Except for these conditions, the shaft of Comparative Example 2 was obtained in the same manner as in Comparative Example 1. The results of evaluation of Comparative Example 2 are shown in the above Table 9. The three-point flexural strength of Comparative Example 2 was: 180 (kgf) at T point; 60 (kgf) at B point; and 125 (kgf) at C point.

Examples 6 to 11

Tests on the relationship between the difference (Lb2–Lb1) and the feeling were conducted. In the butt partial sheet s6 of Example 1, the difference (Lb2–Lb1) was changed by changing the angle of the oblique side while maintaining the distance between the middle point Mp of the oblique side (see FIG. 2) and the butt end Bt. That is, the difference (Lb2–Lb1) was changed by substantially maintaining the weight and the position of the sheet s6. Shafts and clubs of Examples 6 to 11 were obtained in the same manner as in Example 1 except for these conditions. Specifications of Examples were as follows.

[The difference (Lb2–Lb1) of Examples]

Example 6: the difference (Lb2–Lb1) is 30 mm
Example 7: the difference (Lb2–Lb1) is 50 mm
Example 8: the difference (Lb2–Lb1) is 90 mm
Example 1: the difference (Lb2–Lb1) is 130 mm
Example 9: the difference (Lb2–Lb1) is 180 mm
Example 10: the difference (Lb2–Lb1) is 200 mm
Example 11: the difference (Lb2–Lb1) is 250 mm The ten golf players actually hit balls and evaluated the feelings. The method for evaluation was as described above. The evaluations of feelings for the Examples were as follows.

Example 6: 3.5 points
Example 7: 3.8 points
Example 8: 4.1 points
Example 1: 4.5 points
Example 9: 4.1 points
Example 10: 3.9 points
Example 11: 3.3 points As described above, Examples are highly evaluated as compared with Comparative Examples. The advantages of the present invention are apparent.

The invention described above can be applied to any golf clubs.

The above description is merely for illustrative examples, and various modifications can be made without departing from the principles of the present invention.

What is claimed is:

1. A golf club comprising a head, a shaft and a grip, wherein the shaft has a weight of equal to or less than 50 g, the shaft has a ratio of a center of gravity of equal to or greater than 0.54, in the shaft, an EI value at a point 130 mm distant from a tip end is defined as E1, an EI value at a point 230 mm distant from the tip end is defined as E2, an EI value at a point 330 mm distant from the tip end is defined as E3, an EI value at a point 430 mm distant from the tip end is defined as E4, an EI value at a point 530 mm distant from the tip end is defined as E5, an EI value at a point 630 mm distant from the tip end is defined as E6, an EI value at a point 730 mm distant from the tip end is defined as E7, an EI value at a point 830 mm distant from the tip end is defined as E8, an EI value at a point 930 mm distant from the tip end is defined as E9, and an EI value at a point 1030 mm distant from the tip end is defined as E10, a difference (E10–E9) is equal to or greater then 1.0 $kgf \cdot m^2$, a region having a distance of equal to or less than 230 mm from the tip end is defined as a first region, a region having a distance of greater than 230 mm but less than 830 mm from the tip end is defined as a second region, and a region having a distance of equal to or greater than 830 mm from the tip end is defined as a third region, in a graph obtained by plotting the ten EI values on an x-y coordinate plane in which an x axis represents a distance (mm) from the tip end to a measurement point and a y axis represents the EI value ($kgf \cdot m^2$), a gradient of a straight line obtained by approximating the points in the first region with a least-square method is defined as M1, a gradient of a straight line obtained by approximating the points in the second region with the least-square method is defined as M2, and a gradient of a straight line obtained by approximating the points in the third region with the least-square method is defined as M3, and the golf club satisfies the following (a) to (f):

$$-0.015 \le M1 \le 0; \quad (a)$$

$$0.0008 \le M2 \le 0.008; \quad (b)$$

$$0.005 \le M3 \le 0.03; \quad (c)$$

$$M2 < M3; \quad (d)$$

$$1.7 \le E9/E6 \le 3.0; \text{ and} \quad (e)$$

$$2.0 \le E10/E6 \le 4.0. \quad (f)$$

2. The golf club according to claim 1, wherein the shaft has a plurality of fiber reinforced resin layers, the fiber reinforced resin layers include a first hoop layer, a second hoop layer positioned outside the first hoop layer, and an interposition layer positioned between the first hoop layer and the second hoop layer.

3. The golf club according to claim 2, wherein the first hoop layer is a full length layer, the second hoop layer is a full length layer, and the interposition layer includes a full length layer.

4. The golf club according to claim 2, wherein the fiber reinforced resin layers include a butt partial layer, and the butt partial layer is a low-elastic layer having a fiber elastic modulus of equal to or less than 10 $t/mm^2$.

5. The golf club according to claim 4, wherein the low-elastic layer is a glass fiber reinforced layer.

6. The golf club according to claim 1, wherein the shaft includes a plurality of fiber reinforced resin layers, the fiber reinforced resin layers include a butt partial layer, and when a minimum distance between an end at a tip side of the butt partial layer and the tip end of the shaft is defined as Lb1, the minimum distance Lb1 is equal to or greater than 800 mm but equal to or less than 970 mm.

7. The golf club according to claim 1, wherein the shaft includes a plurality of fiber reinforced resin layers, the fiber reinforced resin layers include a butt partial layer, and when a maximum distance between an end at a tip side of the butt partial layer and the tip end of the shaft is defined as Lb2, the maximum distance Lb2 is equal to or greater than 930 mm but equal to or less than 1100 mm.

8. The golf club according to claim 1, wherein the shaft includes a plurality of fiber reinforced resin layers, the fiber reinforced resin layers include a butt partial layer, when a minimum distance between an end at a tip side of the butt partial layer and the tip end of the shaft is defined as Lb1, and a maximum distance between the end at the tip side of the butt partial layer and the tip end of the shaft is defined as Lb2, then a difference (Lb2−Lb1) is equal to or greater than 50 mm but equal to or less than 200 mm.

* * * * *